US010863593B2

(12) United States Patent
Leindecker

(10) Patent No.: US 10,863,593 B2
(45) Date of Patent: Dec. 8, 2020

(54) ELECTRONIC OVEN WITH REFLECTIVE ENERGY STEERING

(71) Applicant: Markov LLC, Los Altos, CA (US)

(72) Inventor: Nick C. Leindecker, Portola Valley, CA (US)

(73) Assignee: Markov LLC, Los Altos, CA (US)

( * ) Notice: Subject to any disclaimer, the term of this patent is extended or adjusted under 35 U.S.C. 154(b) by 249 days.

(21) Appl. No.: 16/009,491

(22) Filed: Jun. 15, 2018

(65) Prior Publication Data

US 2018/0295681 A1 Oct. 11, 2018

Related U.S. Application Data

(63) Continuation of application No. 15/619,390, filed on Jun. 9, 2017, now Pat. No. 10,004,115.

(60) Provisional application No. 62/349,367, filed on Jun. 13, 2016, provisional application No. 62/434,179, filed on Dec. 14, 2016.

(51) Int. Cl.

| | |
|---|---|
| ***H05B 6/70*** | (2006.01) |
| ***H05B 6/74*** | (2006.01) |
| ***H05B 6/78*** | (2006.01) |

(52) U.S. Cl.

CPC ..... *H05B 6/704* (2013.01); *H05B 6/707* (2013.01); *H05B 6/745* (2013.01); *H05B 6/78* (2013.01)

(58) Field of Classification Search

CPC ..... H05B 6/78; H05B 6/707; H05B 6/745; H05B 6/704

USPC ..... 219/695, 746, 748, 749, 750, 751, 753, 219/754, 755, 747, 681, 683, 729

See application file for complete search history.

(56) References Cited

U.S. PATENT DOCUMENTS

| | | | |
|---|---|---|---|
| 2,704,802 | A | 3/1955 | Blass |
| 3,182,166 | A | 5/1965 | Bohm |
| 3,189,722 | A | 6/1965 | Fritz |

(Continued)

FOREIGN PATENT DOCUMENTS

| | | | |
|---|---|---|---|
| EP | 0166622 | A2 | 1/1986 |
| EP | 0543956 | B1 | 12/1995 |

(Continued)

OTHER PUBLICATIONS

Invitation to Pay Additional Fees dated Feb. 22, 2019 from International Application No. PCT/US2018/061083 filed Nov. 14, 2018, 15 pages.

(Continued)

*Primary Examiner* — Quang T Van

(74) *Attorney, Agent, or Firm* — Daylight Law, P.C.

(57) ABSTRACT

Method and systems for heating an item in a chamber where a first electromagnetic wave is applied to an array of variable reflectance elements and a corresponding array of variable impedance devices are disclosed. The corresponding array includes first and second variable impedance devices. The first wave is reflected from the array to the item when the first device has a first impedance value. The reflecting places a local maximum of energy at a first location on the item. An impedance of the first device is altered. A second electromagnetic wave is applied and reflected. The reflecting places the local maximum at a second location on the item. Altering the impedance of the first variable impedance device alters a reflectance of a first variable reflectance element in the array of variable reflectance elements.

30 Claims, 23 Drawing Sheets

(56) References Cited

U.S. PATENT DOCUMENTS

| | | | | |
|---|---|---|---|---|
| 3,364,332 | A | 1/1968 | Sven-Olov Reftmark | |
| 3,370,145 | A | 2/1968 | Malmquist | |
| 3,431,381 | A | 3/1969 | Anderson | |
| 3,461,260 | A | 8/1969 | Bremer | |
| 3,475,577 | A | 10/1969 | Gade | |
| 3,521,019 | A | 7/1970 | White | |
| 4,336,434 | A | 6/1982 | Miller | |
| 4,342,896 | A * | 8/1982 | Teich | H05B 6/725 219/746 |
| 4,414,453 | A | 11/1983 | Simpson | |
| 4,539,454 | A | 9/1985 | Yangas | |
| 4,683,362 | A | 7/1987 | Yangas | |
| 4,877,933 | A | 10/1989 | Yangas | |
| 4,992,638 | A | 2/1991 | Hewitt | |
| 5,107,086 | A | 4/1992 | Yangas | |
| 5,519,195 | A | 5/1996 | Keefer | |
| 5,698,128 | A | 12/1997 | Sakai | |
| 6,674,056 | B2 | 1/2004 | Lee | |
| 2003/0090422 | A1 | 5/2003 | Diament | |
| 2008/0290087 | A1 | 11/2008 | Ben-shmuel | |
| 2009/0045191 | A1 | 2/2009 | Ben-shmuel | |
| 2010/0059509 | A1 | 3/2010 | Imai | |
| 2011/0168699 | A1 * | 7/2011 | Oomori | H01L 21/67115 219/748 |
| 2013/0142923 | A1 | 6/2013 | Torres | |
| 2013/0175262 | A1 | 7/2013 | Gharpurey | |
| 2013/0240507 | A1 | 9/2013 | Kimrey | |
| 2015/0136760 | A1 | 5/2015 | Lima | |
| 2017/0257914 | A1 | 9/2017 | Nikishov et al. | |

FOREIGN PATENT DOCUMENTS

| | | | | |
|---|---|---|---|---|
| EP | 2051563 | A1 | 4/2009 | |
| EP | 2773163 | A1 | 9/2014 | |
| JP | S52122950 | U | 9/1977 | |
| JP | S55160095 | U | 11/1980 | |
| JP | S6113497 | U | 1/1986 | |
| JP | H0845656 | A | 2/1996 | |
| JP | H09232072 | | 9/1997 | |
| JP | 2000357583 | A * | 12/2000 | H05B 6/72 |
| JP | 2001307868 | A | 11/2001 | |
| JP | 2002275770 | A | 9/2002 | |
| JP | 2008224078 | A | 9/2008 | |
| JP | 2008281283 | A | 11/2008 | |
| WO | 2013021285 | A1 | 2/2013 | |
| WO | 2013059080 | A2 | 4/2013 | |
| WO | 2014198637 | A1 | 12/2014 | |
| WO | 2017172539 | A1 | 10/2017 | |

OTHER PUBLICATIONS

Notice of Allowance dated Apr. 18, 2019 from U.S. Appl. No. 16/015,848, 20 pages.

Extended European Search Report dated Jun. 17, 2019 from European Application No. 19161457.7, 7 pages.

Notice of Acceptance dated Dec. 9, 2019 from Australian Patent Application No. 2018267603, 3 pages.

Notice of Allowance dated Dec. 31, 2019 from Chinese Patent Application No. 201780011571.7, 5 pages.

PCT International Preliminary Report on Patentability_PCT/US2017/036970_dated Dec. 27, 2018.

Examination Report dated Jul. 15, 2019 from Australian Patent Application No. 2018267603, 3 pages.

Office Action from Brazilian Patent Application No. BR 112018002675-1 dated Jul. 2, 2019, 14 pages.

Office Action from Chinese Patent Application No. 201780011571.7 dated May 7, 2019, 13 pages.

Second Examination Report dated Jun. 28, 2019 from European Patent Application No. 17717281.4, 7 pages.

Non-final Office Action dated Jan. 17, 2018 for U.S. Appl. No. 15/619,390.

Notice of Allowance dated May 14, 2018 for U.S. Appl. No. 15/619,390.

PCT International Search Report_PCT/US2017/036970_dated Sep. 22, 2017.

Examination Report dated Jun. 21, 2018 for AU Patent Application No. 2017286520, Australian Patent Office.

* cited by examiner

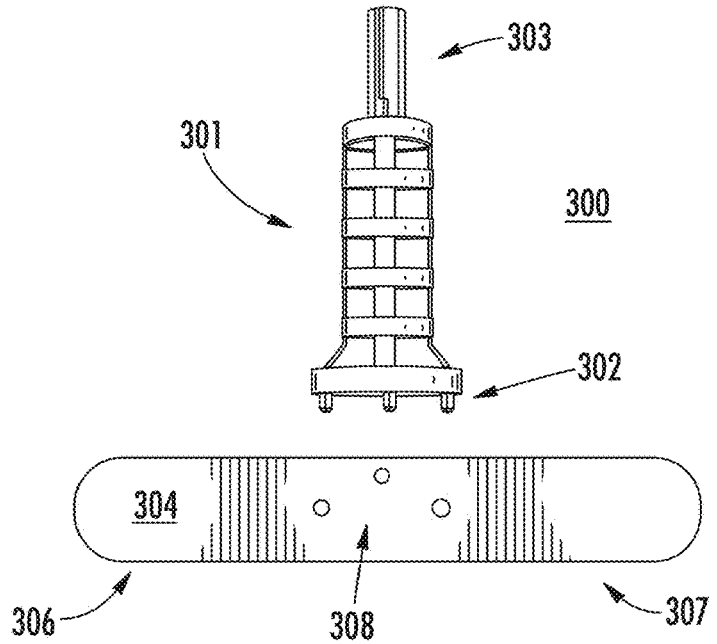
FIG. 3
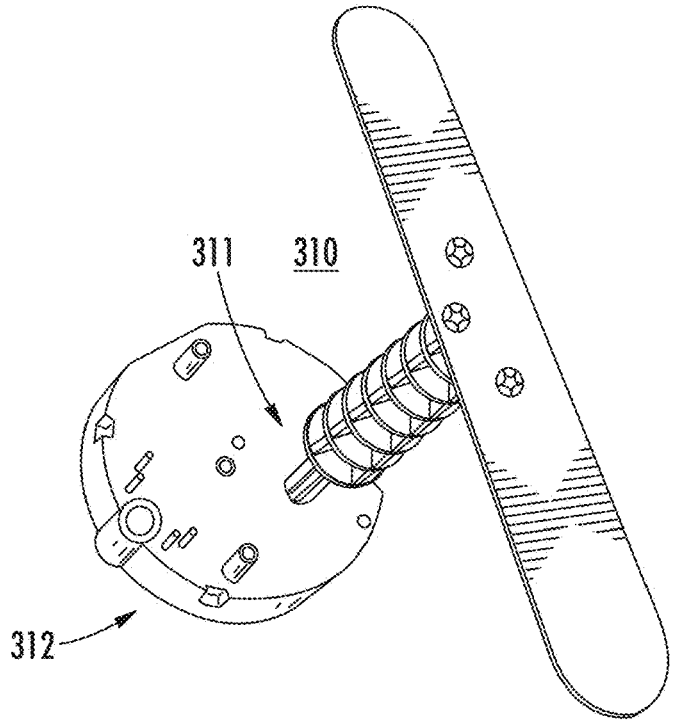

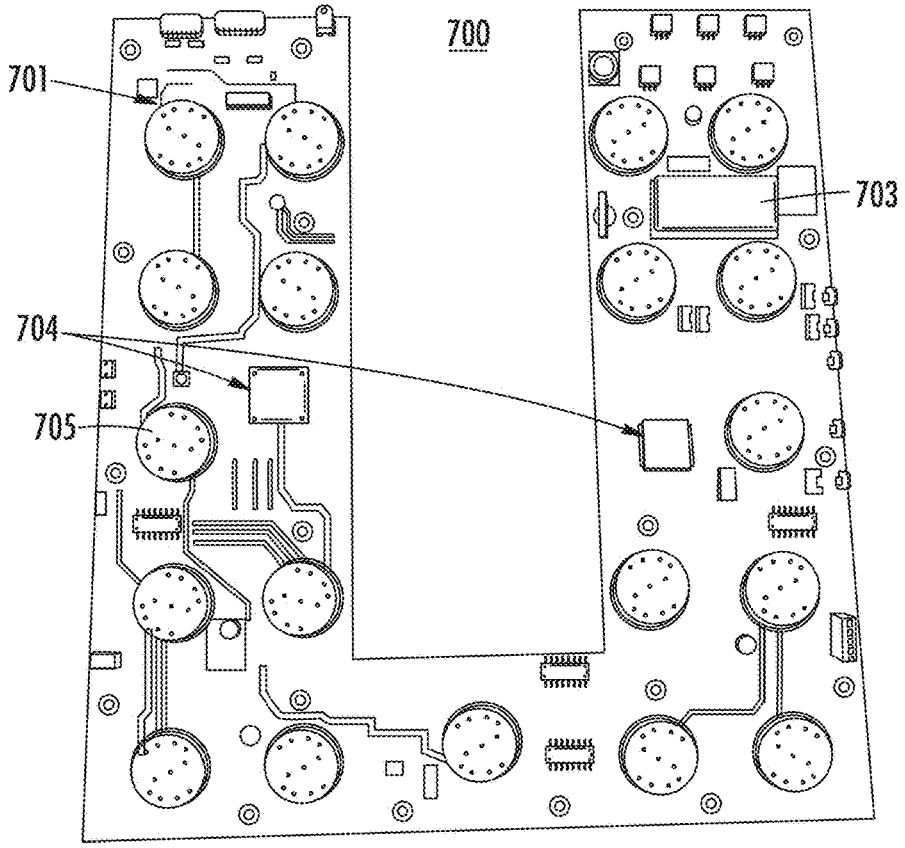
FIG. 7
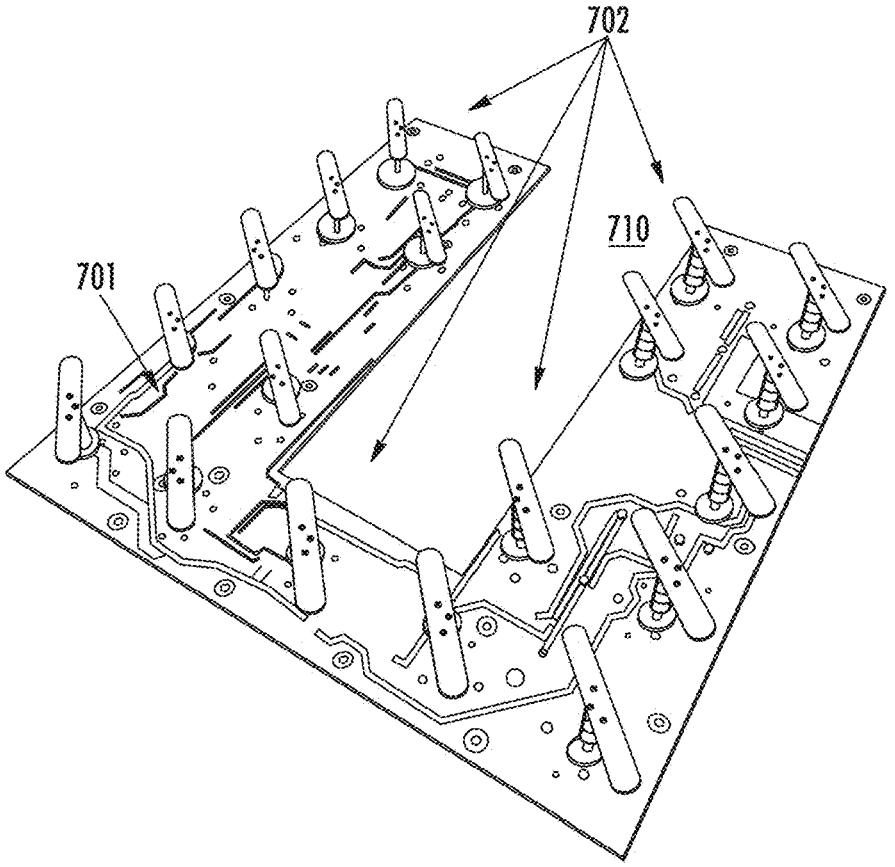

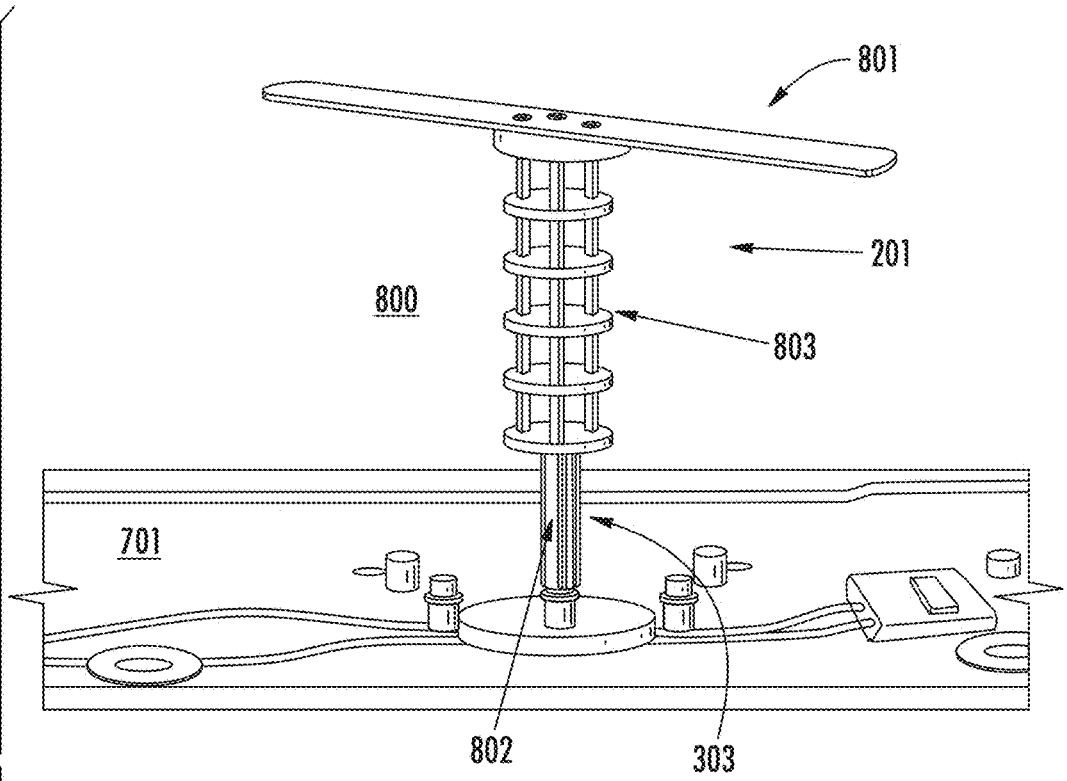
FIG. 8
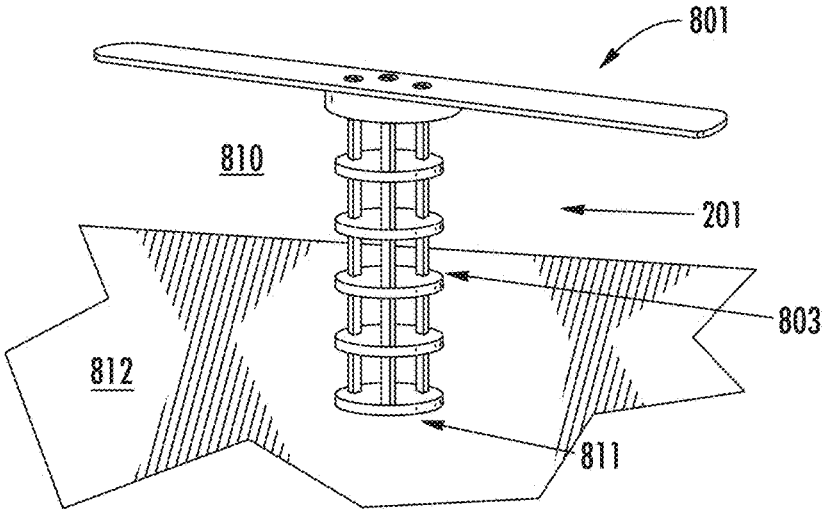

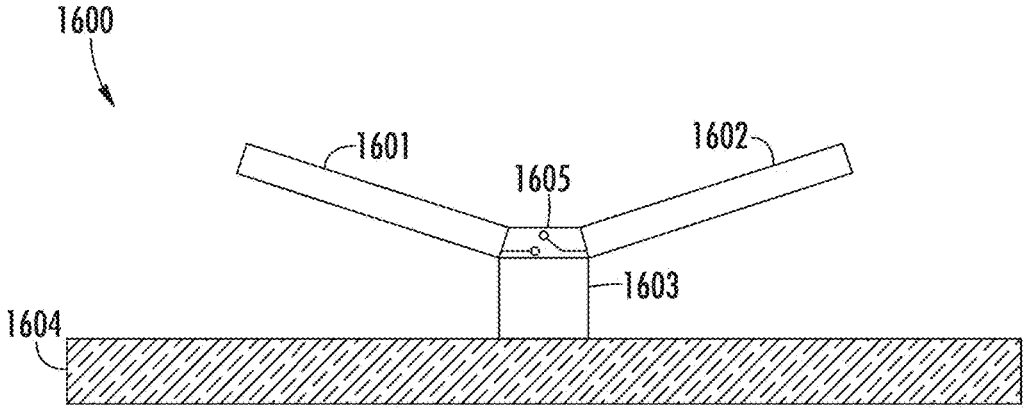
FIG. 16
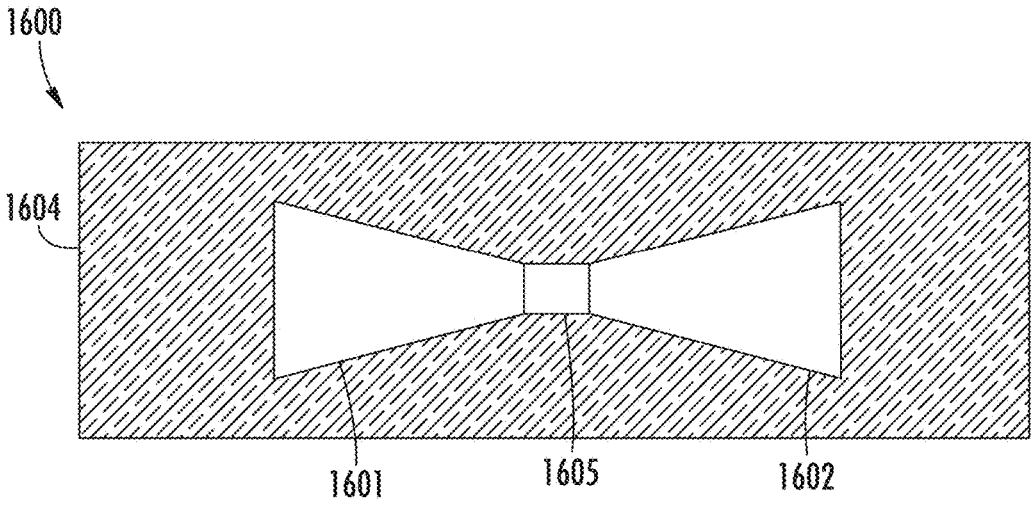

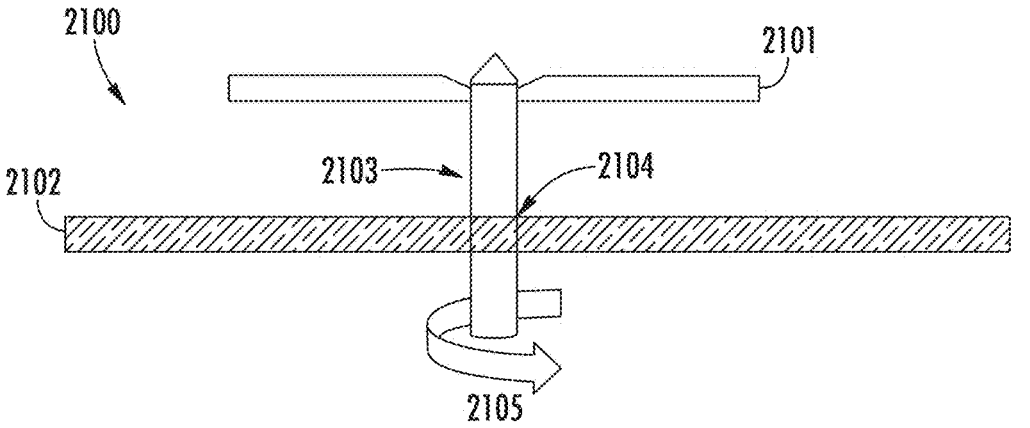
FIG. 21
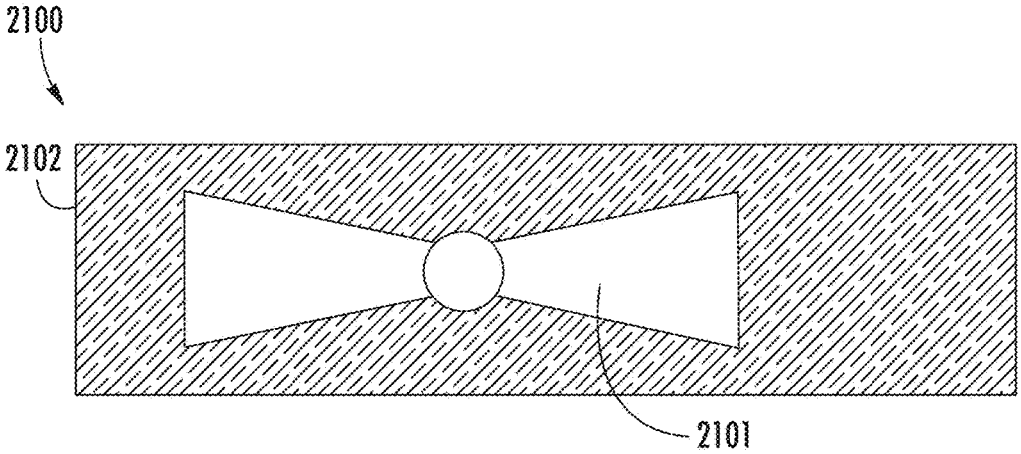

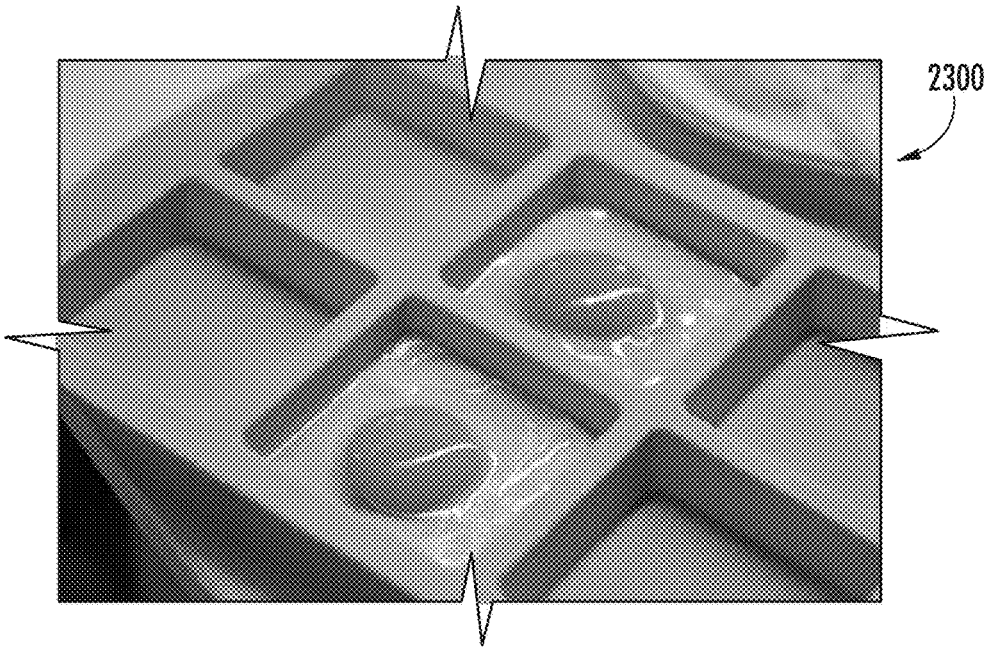
FIG. 23
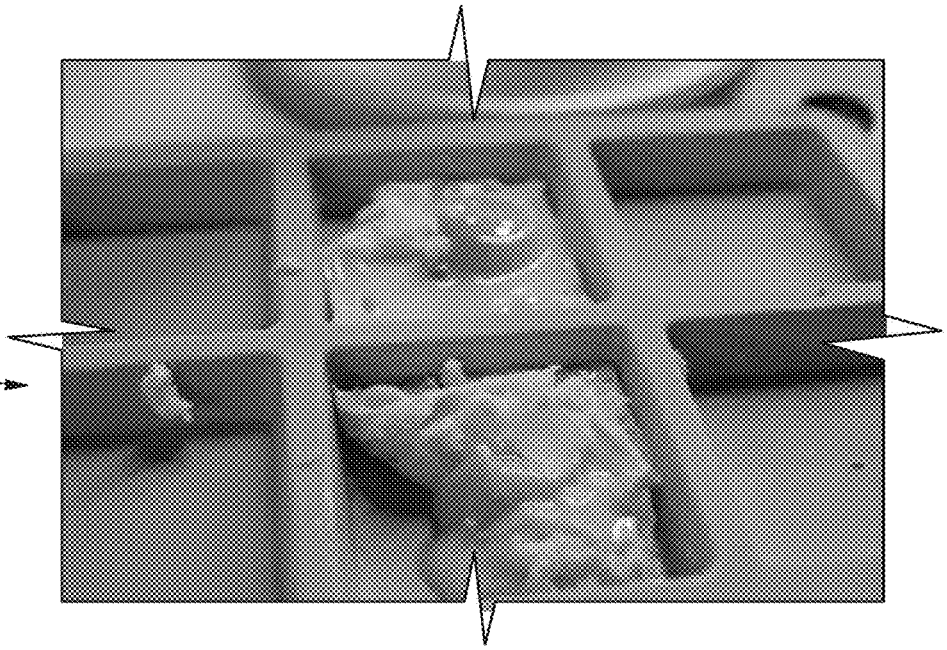

ELECTRONIC OVEN WITH REFLECTIVE ENERGY STEERING

CROSS REFERENCE TO RELATED APPLICATIONS

This application is a continuation of U.S. patent application Ser. No. 15/619,390, filed Jun. 9, 2017, which claims the benefit of U.S. Provisional Application No. 62/434,179, filed Dec. 14, 2016, and U.S. Provisional Application No. 62/349,367, filed Jun. 13, 2016, all of which are incorporated by reference herein in their entirety for all purposes.

BACKGROUND OF THE INVENTION

Electronic ovens heat items within a chamber by exposing them to strong electromagnetic fields. In the case of typical microwave ovens, the electromagnetic fields are a result of microwave radiation from a magnetron, and most often take the form of waves with a frequency of either 2.45 GHz or 915 MHz. The wavelength of these forms of radiation are 12 cm and 32.8 cm respectively. While heating, the electromagnetic waves in the chamber of a magnetron-powered microwave oven may drift or hop in frequency for short periods of time, generally within a range of +/−5%. For purposes of this disclosure, the mean temporal wavelength of an electromagnetic wave is referred to as the "dominant wavelength" of the associated electromagnetic wave, and dimensions of an electronic oven that are given with respect to a frequency or wavelength of an electromagnetic wave refer to the frequency or wavelength of the dominant wavelength of that electromagnetic wave.

The waves within the microwave oven that are not absorbed by the heated item reflect within the chamber and cause standing waves. Standing waves are caused by the constructive and destructive interference of waves that are coherent but traveling in different directions. The combined effect of the reflected waves is the creation of local regions of high and low microwave field intensity, or antinodes and nodes. The waves may interfere destructively at the nodes to create spots where little or no energy is available for heating. The waves interfere constructively at the antinodes to create spots where peak energy is available. The wavelength of the radiation is appreciable compared to the length scales over which heat diffuses within an item during the time that it is being heated. As a result, electronic ovens tend to heat food unevenly compared to traditional methods.

Electronic ovens are also prone to heat food unevenly because of the mechanism by which they introduce heat to a specific volume of the item being heated. The electromagnetic waves in a microwave oven cause polarized molecules, such as water, to rotate back and forth, thereby delivering energy to the item in the form of kinetic energy. As such, water is heated quite effectively in a microwave, but items that do not include polarized molecules will not be as efficiently heated. This compounds the problem of uneven heating because different portions of a single item may be heated to high temperatures while other portions are not. For example, the interior of a jelly doughnut with its high sucrose and water content will get extremely hot while the exterior dough does not.

Traditional methods for dealing with uneven cooking in electronic ovens include moving the item that is being heated on a rotating tray and homogenizing the distribution of electromagnetic energy with a rotating stirrer. These approaches prevent an antinode of the electromagnetic waves from being applied to a specific spot on the item which would thereby prevent uneven heating. However, both approaches are essentially random in their treatment of the relative location of an antinode and the item itself. They also do not address the issue of specific items being heated unevenly in the microwave. In these approaches, the heat applied to the chamber is not adjusted based on the location, or specific internal characteristics, of the item being heated.

BRIEF DESCRIPTION OF THE DRAWINGS

FIG. 3 illustrates a variable reflectance element in a disassembled state and attached to a drive motor.

FIG. 7 illustrates a printed circuit board with a set of drive motors for altering the orientation of a set of variable reflectance elements. The figure includes a top down view of the front side of the printed circuit board and an isometric view of the back side of the printed circuit board.

FIG. 8 illustrates the detail of mounting a variable reflectance element to the printed circuit board and the variable reflectance element in relation to a surface of a chamber of an electronic oven.

FIG. 16 illustrates two variable reflectance elements from a side view and a plan view.

FIG. 21 illustrates a side view and a plan view of a variable reflectance element with a reflective element that physically moves from a first position to a second position.

FIG. 23 illustrates two sets of eggs that were heated using the same amount of time and energy, but with one set heated using variable reflectance elements applied to more evenly distribute heat in the chamber.

SUMMARY

Figure 1:
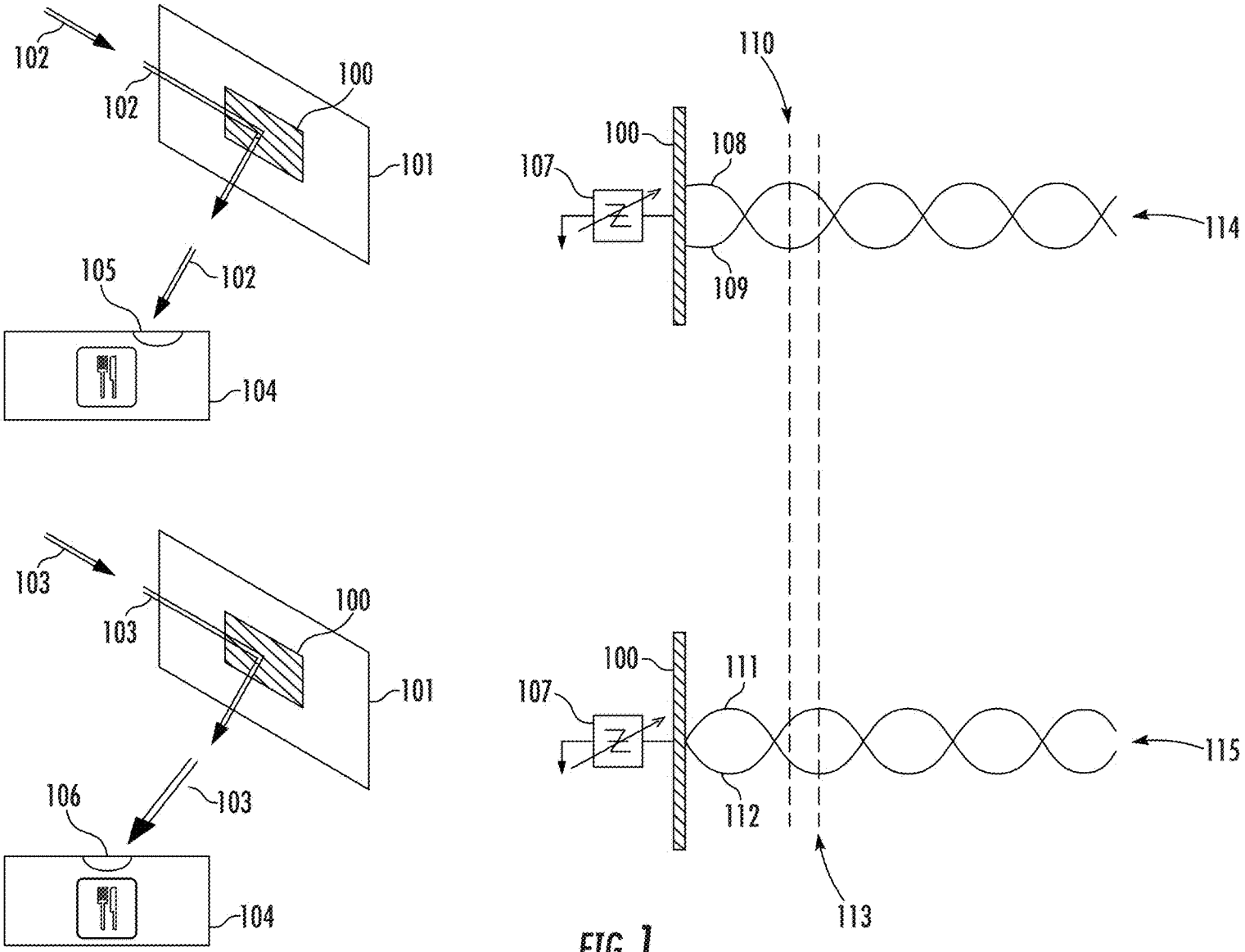
FIG. 1 illustrates the spatial relationship of a local maximum of the distribution of energy in a chamber as that energy is reflected off a variable reflectance element, along with the standing wave envelope of the energy in the vicinity of that element, at two different phase settings of the element.

An electronic oven with a set of variable reflectance elements for controlling a distribution of heat in the electronic oven and associated methods are disclosed herein. The electronic oven includes a chamber, an energy source coupled to an injection port in the chamber, and a set of variable reflectance elements located in the chamber. In some of the disclosed approaches the variable reflectance elements are nonradiative. A control system of the electronic oven can be configured to alter the states of the variable reflectance elements to thereby alter and control the distribution of energy within the chamber.

In one approach, an electronic oven with a set of reflective elements for controlling a distribution of heat in the electronic oven includes a chamber, a microwave energy source coupled to an injection port in the chamber, a set of dielectric spindles that extend through a set of perforations in the chamber, and a set of motors connected to the set of dielectric spindles. The set of reflective elements are held above a surface of the chamber by the set of dielectric spindles. The set of motors rotate the set of reflective elements via the set of dielectric spindles. The set of motors, the set of reflective elements, and the set of dielectric spindles are each sets of at least three units.

In another approach, the electronic oven comprises a heating chamber, a set of reflective elements in the heating chamber, a microwave energy source configured to apply a polarized electromagnetic wave to the heating chamber, a set of dielectric spindles that extend through an outer wall of the heating chamber, and a set of motors that individually rotate the set of reflective elements via the set of dielectric spindles between a first position with a first orientation and a second position with a second orientation. A dominant polarization of the polarized electromagnetic wave is perpendicular to the first orientation. The dominant polarization of the polarized electromagnetic wave is parallel to the second orientation.

In another approach, a method for heating an item in a chamber of an electronic oven comprises applying a first polarized electromagnetic wave to the chamber from an energy source to a set of reflective elements in the chamber. The set of reflective elements are held above a surface of the chamber by a set of dielectric spindles. The method also comprises independently rotating each of the reflective elements in the set of reflective elements using a set of motors and the set of dielectric spindles. Independently rotating each of the reflective elements includes rotating a first reflective element in the set of reflective elements from a first position to a second position. The method also includes reflecting, when the first reflective element is in the first position, the first polarized electromagnetic wave from the set of reflective elements to the item. The reflecting places a local maximum of energy at a first location on the item. The method also comprises applying, after rotating the first reflective element in the set of reflective elements to the second position, a second polarized electromagnetic wave to the chamber from the energy source; and reflecting, when the first reflective element is in the second position, the second polarized electromagnetic wave from the set of reflective elements to the item. The reflecting places the local maximum of energy at a second location on the item. The first location and the second location are different. The first reflective element has a first orientation in the first position and a second orientation in the second position. A dominant polarization of the first polarized electromagnetic wave is perpendicular to the first orientation. A dominant polarization of the second polarized electromagnetic wave is parallel to the second orientation. The dominant polarization of the first polarized electromagnetic wave is equal to the dominant polarization of the second polarized electromagnetic wave.

DETAILED DESCRIPTION

Reference now will be made in detail to embodiments of the disclosed invention, one or more examples of which are illustrated in the accompanying drawings. Each example is provided by way of explanation of the present technology, not as a limitation of the present technology. In fact, it will be apparent to those skilled in the art that modifications and variations can be made in the present technology without departing from the scope thereof. For instance, features illustrated or described as part of one embodiment may be used with another embodiment to yield a still further embodiment. Thus, it is intended that the present subject matter covers all such modifications and variations within the scope of the appended claims and their equivalents.

Methods and systems disclosed herein allow for the steering of electromagnetic energy in an electronic oven. These methods and systems can be used to alter the distribution of electromagnetic energy, created by the pattern of nodes and antinodes, in the chamber while an item is being heated in the chamber. In some approaches, the distribution is altered to more evenly heat the item throughout the heating process. The disclosed systems can include a reflective array of variable reflectance elements inside the chamber that allow for control of the intensity and distribution of energy within the chamber.

A control system can be configured to alter the states of the variable reflectance elements and thereby alter the distribution. The array of variable reflectance elements can include an associated array of variable impedance elements that are controlled by the control system. The impedance of the variable impedance elements can be set to different impedance values. Altering the impedance value can alter a reflectance of the variable reflectance elements. In particular, the reflectance can be altered to adjust a phase shift introduced to reflected electromagnetic energy of a particular wavelength. The array of variable reflectance elements can also comprise a set of electrically reflective elements that can be moved from one position to another position. The position of the elements in the set of electrically reflective elements can be altered to change the distribution of energy in the chamber. In particular, the position of the reflective elements can be altered to adjust the orientation of the reflective element with respect to the dominant polarization of an electromagnetic wave in the chamber.

As will be described below, altering the reflectance of the variable reflectance elements can alter the distribution and intensity of energy in the chamber. To this end, the control system can be configured to control each variable impedance element in an array separately or along with a particular subset of elements in the array. In certain approaches, the control system can control at least two of the variable impedance elements independently. In like manner, in approaches in which the chamber includes a set of at least two reflective elements that can be moved between different positions, the control system can control the position of the at least two reflective elements independently.

FIG. 1 provides an example of how altering the reflectance of a variable reflectance element can alter the distribution and intensity of energy in a chamber. FIG. 1 includes a variable reflectance element 100 embedded in a wall of the chamber 101. Variable reflectance element 100 is bombarded with incident electromagnetic waves 102 and 103 from an energy source. The doses of electromagnetic energy are applied at different times. The energy reflects off element 100 to item 104. Item 104 is the item being heated by the electromagnetic energy in the electronic oven. The waveforms 114 and 115 represent the standing wave envelope in the vicinity of variable reflectance element 100 at different phase settings of variable reflectance element 100. The images on the left of FIG. 1 illustrate the spatial relationship of the locations of a local maximum of the distribution of energy in the chamber to the state of variable reflectance element 100. When wave of electromagnetic energy 102 is applied, the variable reflectance element 100 is in a first state and the local maximum is at location 105 on item 104. When wave of electromagnetic energy 103 is applied, the variable reflectance element 100 is in a second state and the local maximum is at location 106 on item 104. As a result, the location of the local maximum will move from one location on the item 104 to another without the energy source needing to alter the characteristics of the energy it produces. Indeed, the waves of electromagnetic energy 102 and 103 can simply be the energy applied by a single unchanging stream of energy across two different time segments.

Variable reflectance element 100 can include a variable impedance element 107. In this approach, the state of the variable reflectance element can be changed by altering an impedance of the variable impedance element from a first impedance value to a second impedance value. As illustrated, the variable impedance element 107 couples a body of variable reflectance element 100 to the cavity wall. However, the variable impedance element could alternatively couple the body of variable reflectance element 100 to a different variable reflectance element. For illustrative purposes, variable reflectance element 100 is an ideal conductor that exhibits near perfect reflectance. Therefore, the incoming wave 108 of waveform 114 sums to zero with the outgoing wave 109 at the surface of variable reflectance element 100.

With reference to FIG. 1, it can be illustrated how the change in impedance of the variable impedance element can shift the distribution of energy within the chamber. The combination of incoming wave 108 and outgoing wave 109 creates a standing wave with an antinode at location 110, creating a local maximum of energy at that point. However, if the impedance of variable impedance element 107 is changed to a second value, the phase of the standing wave can be altered. As illustrated, the incoming wave 111 and outgoing wave 112 still sum to zero at the surface of variable reflectance element 100, but the location of the antinode has been shifted to location 113. Therefore, by tuning the impedance of the variable impedance element, the distribution of local maxima in the chamber can be modified.

Figure 2:
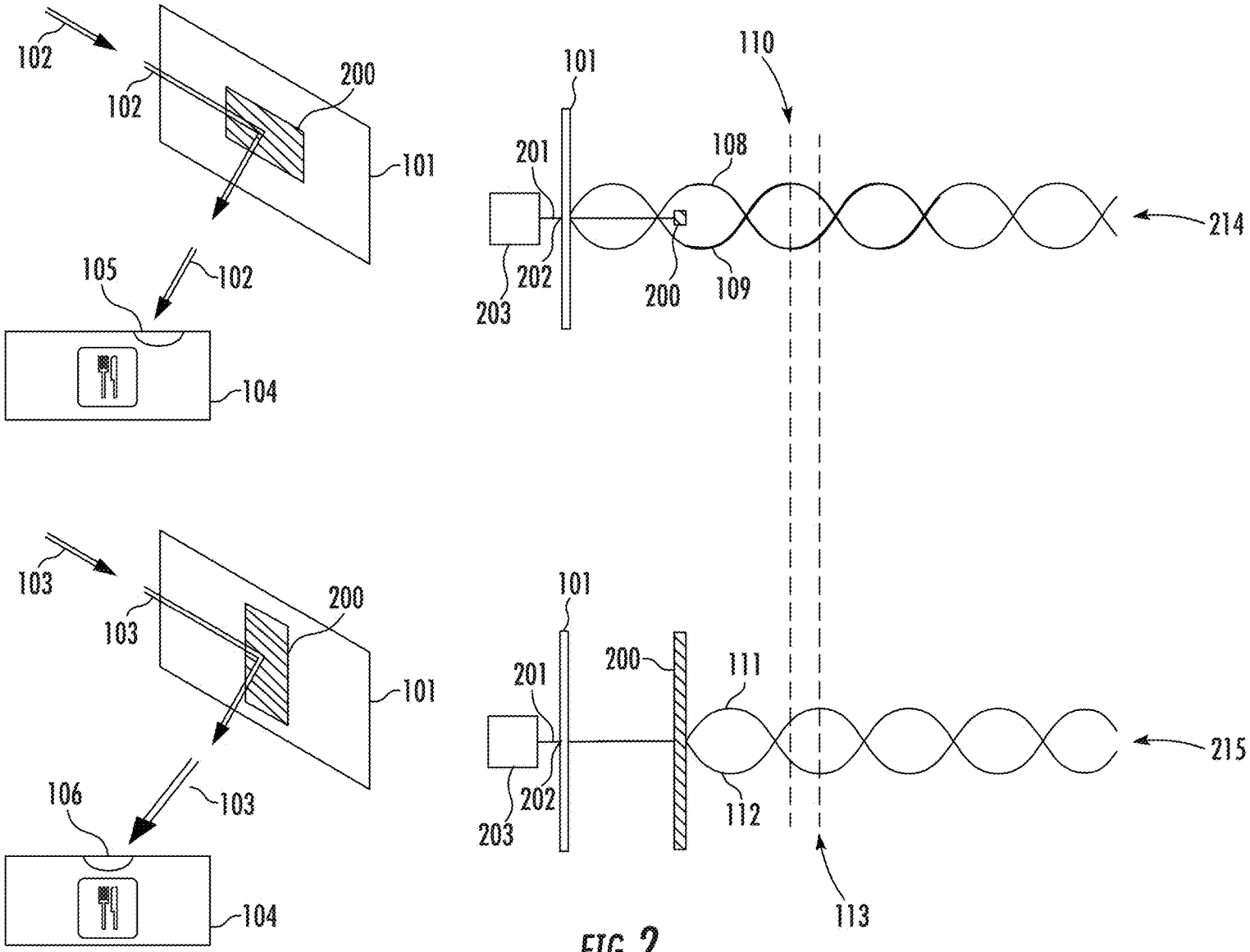
FIG. 2 illustrates the spatial relationship of a local maximum of the distribution of energy in a chamber as that energy is reflected off a variable reflectance element, along with the standing wave envelope of the energy in the vicinity of that element, at two different orientations of the element relative to the polarization of the incoming wave.

FIG. 2 provides another example of how altering the reflectance of a variable reflectance element can alter the distribution and intensity of energy in a chamber. FIG. 2 includes a variable reflectance element 200 on a wall of the chamber 101. Like elements from FIG. 1 are correspondingly labeled in FIG. 2 and are in accordance with the disclosure above. As with FIG. 1, the images on the left of FIG. 2 illustrate the spatial relationship of the locations of a local maximum of the distribution of energy in the chamber to a state of variable reflectance element 200. When wave of electromagnetic energy 102 is applied, the variable reflectance element 200 is in a first state and the local maximum is at location 105 on item 104. When wave of electromagnetic energy 103 is applied, the variable reflectance element 200 is in a second state and the local maximum is at location 106 on item 104. As a result, the location of the local maximum will move from one location on the item 104 to another without the energy source needing to alter the characteristics of the energy it produces. Indeed, the waves of electromagnetic energy 102 and 103 can simply be the energy applied by a single unchanging stream of energy across two different time segments.

The characteristics of variable reflectance element 200 differ from that of FIG. 1. As illustrated, the change in state upon receipt of electromagnetic wave 102, as compared to electromagnetic wave 103, is characterized by the physical movement of the variable reflectance element 200. The phase of the reflectance depends on the relative orientation of the incident wave polarization, and the axis of the variable reflectance element. The electromagnetic waves applied to the chamber can be a polarized or partially polarized electromagnetic wave. Therefore, by altering the orientation of the variable reflectance elements, the distribution of energy in the chamber can be altered. Distribution 214 is caused when variable reflectance element 200 is in a first position with a first orientation. Distribution 215 is caused when variable reflectance element 200 is in a second position with a second orientation. In this example, the polarization of the incident electromagnetic waves 102 and 103 is the same. Distribution 214 is caused when the orientation of variable reflectance element 200 is parallel to the wave polarization. Distribution 215 is caused when the orientation of variable reflectance element 200 is perpendicular to the wave polarization.

Variable reflectance element 200 can include an electrically reflective element such as a conductive bar or sheet of metal. The reflectance element can be attached to a dielectric spindle 201. The dielectric spindle 201 can extend through a perforation 202 in a wall of the chamber 101. A motor 203 can be configured to apply a force to dielectric spindle 201. For example, the motor could be configured to rotate the dielectric spindle 201 and thereby rotate the electrically reflective element. In alternative approaches, the variable reflectance elements can be physically repositioned in various ways as mentioned elsewhere such as by any form of rotating or translating. Also, the variable reflectance elements can be physically repositioned using any form of linear or rotary actuators.

With reference to FIG. 2, it can be illustrated how the change in orientation of the variable reflectance element can shift the distribution of energy within the chamber. The combination of incoming wave 108 and outgoing wave 109 creates a standing wave with an antinode at location 110, creating a local maximum of energy at that point. This is because the orientation of the variable reflectance element is perpendicular to the polarization of incoming wave 108 and so the wave essentially ignores the reflective element and is instead reflected by the wall of the chamber 101. As illustrated, the electromagnetic waves 108 and 109 sum to zero at the surface of the chamber. However, if the orientation of variable reflectance element 200 is changed to a second value, the phase of the standing wave can be altered. As illustrated, the incoming wave 111 and outgoing wave 112 instead sum to zero at the surface of the reflective element 200, and the location of the antinode has been shifted to location 113. This is because the orientation of the variable reflectance element is parallel to the polarization of incoming wave 111 and so the wave reflects perfectly off the reflective element. Therefore, by altering the orientation of the variable reflectance elements, the distribution of local maxima in the chamber can be modified.

The operations illustrated by FIGS. 1 and 2 can be conceptualized as virtually resizing the chamber for a particular incident polarization. A careful review of FIGS. 1 and 2, and comparisons of locations 110 and 113 in each of the figures, illustrates how changing the impedance of variable impedance device 107, or the position of variable reflectance element 200, can have the same effect as physically moving the location of a wall of the chamber. Electromagnetic waves will reflect off the walls of the chamber of an electromagnetic oven regardless of the presence of variable reflectance elements. The pattern of reflection, in the absence of variable reflectance elements, will cause what can be referred to as an inherent distribution within the chamber. If the chamber were to be resized, the inherent distribution would be altered. The wave of electromagnetic energy is characterized by its wavelength and polarization. The wave will generally have a node at the wall of the chamber due to the anti-phase reflection from a conductive surface. Therefore, the local maxima would move along with the movement of the chamber wall. However, changing the phase of the reflected waves as in FIG. 1 achieves the same movement of the local maxima without any moving parts. As seen in FIG. 1, altering the phase between that used to reflect electromagnetic wave 102 and 103 achieves the same result as physically moving the chamber wall a distance equal to a quarter of the wavelength of the applied energy. In other words, the chamber has been virtually resized by a quarter wavelength. In addition, changing the orientation of a reflective element likewise serves to virtually resize the chamber. As seen in FIG. 2, altering the orientation of the reflective elements used to reflect electromagnetic wave 102 and 103 achieves the same result as physically moving the chamber wall. In this case, the change will be equal to a distance that the reflective element is set off from the wall, which could potentially be set to a quarter wavelength.

A specific implementation of the variable reflectance elements is provided in FIG. 3, which shows the element in a disassembled state 300 and an assembled state 310. The variable reflectance element includes a dielectric spindle 301 with a set of connection prongs 302 and a drive shaft connection cylinder 303. The dielectric spindle can be formed of plastic. The dielectric spindle can be injection molded. The variable reflectance element includes a reflective element 304. In this example, the reflective element is a paddle of punched aluminum sheet metal, but other conductive materials can be used such as steel or copper. Reflective element 304 includes a first surface 306 and a second surface 307. When assembled and placed in an electronic oven, first surface 306 and second surface 307 will extend away from the dielectric spindle and lie substantially parallel to a surface of the chamber. Both the first and second surface have an aspect ratio greater than 1:2. In this example, the paddle has a length of 6 cm and a width of 1 cm. The material for the reflective element can be easy to punch through while still maintaining sufficient structural rigidity and long-term durability. In the illustrated case, the paddle is 0.6 mm thick and is therefore easy to punch. The paddle also has rounded corners with a radius of 0.5 cm. Both surfaces will interact with electromagnetic waves in the chamber in widely different manners depending upon the angle at which dielectric spindle is positioned.

In FIG. 3, reflective element 304 includes three spindle connectors 308. The spindle connectors can be formed at the same time as the overall shape of the element is formed. Spindle connectors 308 accept connection prongs 302 from dielectric spindle 301. In situations where the connection prongs are plastic, and the reflective element is metal, the element can be easily assembled by melting the plastic through a brief application of heat to form a permanent bond between the spindle and the reflective element. As shown in assembled state 310, the plastic has been melted down to the plane of the paddle such that the first and second surfaces of the paddle form one effectively contiguous plane with an aspect ratio of 1:6.

The variable reflectance element shown in assembled state 310 is shown with a drive motor 312. Drive motor 312 can be a gauge motor used to position an indicator needle in a standard automobile dash board display. Approaches that utilize gauge motors exhibit certain benefits in that the motors are widely available, are PCB-mountable, and are designed to be positioned at specific angles that are known to the controller of the gauge motor. This characteristic is beneficial in that it inherently provides a controller with information regarding the position of the reflective element for a given control condition. As certain control systems described herein depend on keeping track of the specific orientation of each variable reflectance element, the ease with which this information is obtained from a gauge motor is beneficial. Drive motor 312 can include a motor drive shaft that is mated to drive shaft connection cylinder 303 as shown by reference line 311. The radius of drive shaft connection cylinder 303 can be selected to allow the motor drive shaft to slip into the connection cylinder and form a friction connection.

Figure 4:
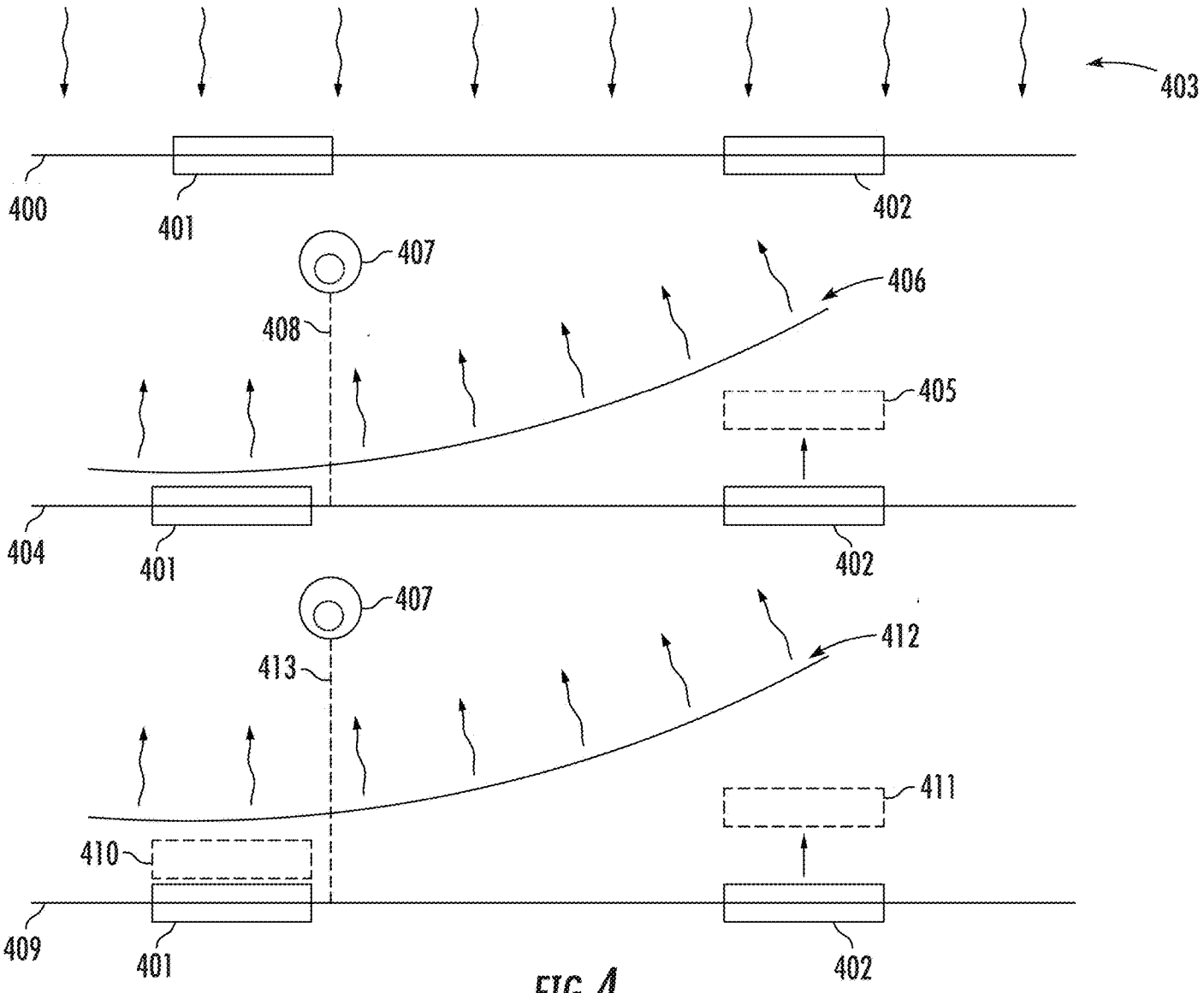
FIG. 4 illustrates a wall of an electronic oven introducing different phase shifts in a reflected electromagnetic wave based on the state of two variable reflectance elements.

FIG. 4 illustrates how a simple array of two variable reflectance elements can steer the local maxima of a distribution of energy with a greater degree of freedom as compared to the one-dimensional case provided by a single variable reflectance element. FIG. 4 illustrates a wall of an electronic oven in a first state 400. The wall includes two phase shifting elements 401 and 402. In first state 400, the phase shifting elements are in a neutral state which creates an inherent, or baseline, distribution of energy in the chamber of the electronic oven in response to the incident wave of electromagnetic energy 403.

FIG. 4 also illustrates the wall of the electronic oven in a second state 404 in which the chamber has been virtually resized by a change in the state of phase shifting element 402. As illustrated, the state of phase shifting element 402 has been changed such that the chamber has been virtually resized as if the reflection of phase shifting element 402 was occurring at the location marked with phantom lines 405. At the same time, the state of phase shifting element 401 has been held constant. Such a situation is facilitated by the fact that the control system for phase shifting elements 401 and 402 is able to modify the state of the phase shifting elements independently. For example, the motors used to rotate a variable reflectance element associated with phase shifting elements 401 and 402 can rotate element 402 while keeping element 401 still. In response to the incident wave of electromagnetic energy identical to 403, the wall in second state 404 will create a curved reflection pattern 406 that places a local maximum 407 a distance 408 from the wall. Note that local maximum 407 is not illustrated with reference to state 400, but the local maximum for first state 400 would likely be closer to phase shifting element 402. Also, local maximum 407 is not the only local maxima created by the reflection of wave of electromagnetic energy 403 off of the wall of the chamber.

FIG. 4 also illustrates the wall of the electronic oven in a third state 409 in which the chamber has again been virtually resized by a change in the state of phase shifting element 401 and by another change in the state of phase shifting element 402. In the transition from state 404 to 409 the phase shifting elements 401 and 402 have been changed to an equal degree. As an example, if the phase shifting elements were each associated with a variable impedance device, the impedance value of both those variable impedance devices would be changed by an equal degree in the transition from state 404 to 409. As a result of this modification, local maximum 407 would stay roughly the same lateral distance from both of the phase shifting elements, but would be moved out and away from the wall to a new distance 413 that is greater than distance 408. As illustrated by these three states, the use of multiple phase shifting elements in an array presents increasing degrees of freedom in terms of the ability to change the location of a local maximum of the distribution of energy in the chamber.

Figure 5:
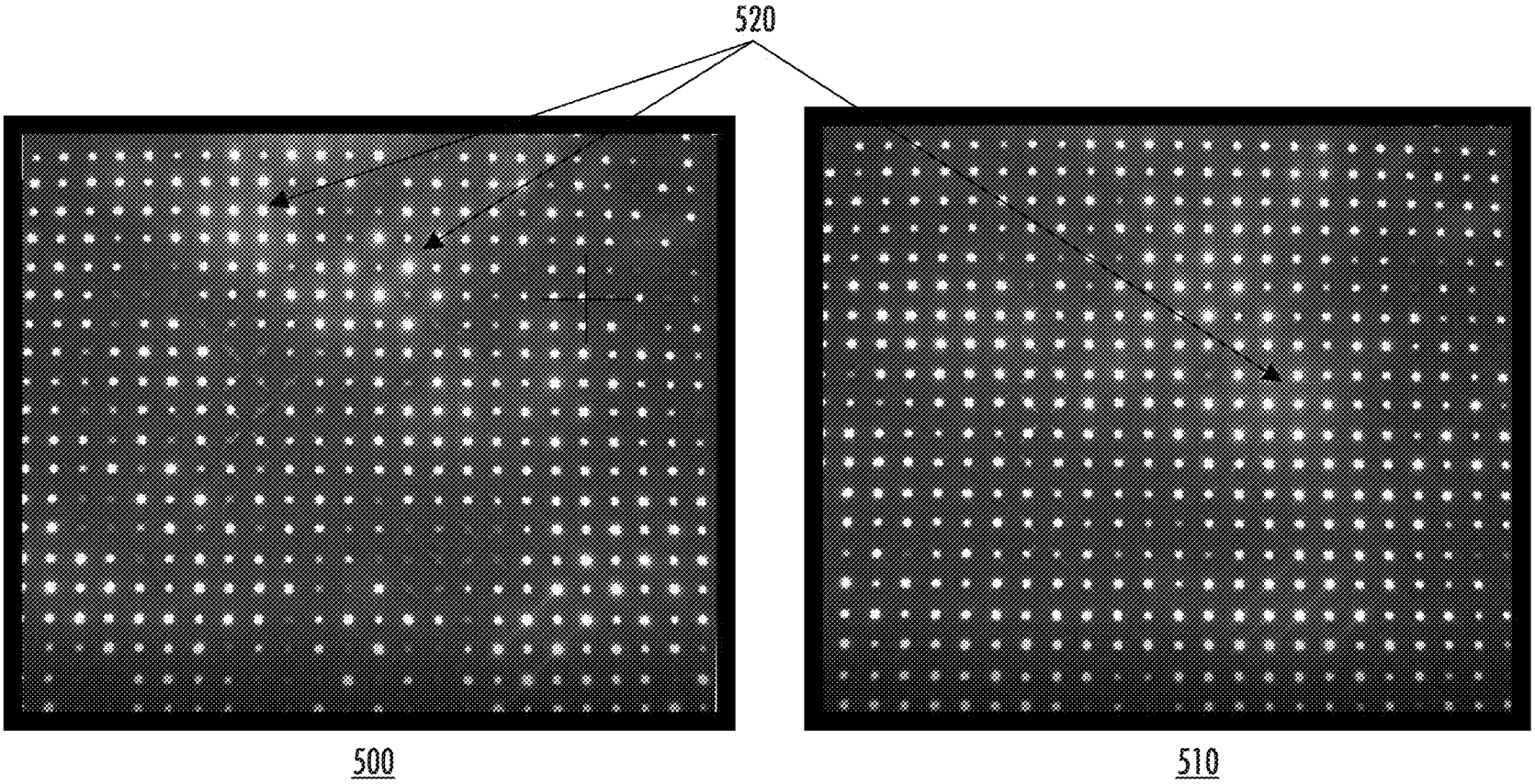
FIG. 5 illustrates an RF-responsive array of LEDs in a chamber of an electronic oven in two states receiving energy from a microwave energy source under the influence of a set of variable reflectance elements in two different configurations.

As the number of variable reflectance elements increases, the degrees of freedom available to the control system of the electronic oven continue to increase. When the number of elements exceeds three, and further when the number of elements exceeds five, the controller is able to produce complex distributions of the energy in the chamber to heat an item in the chamber more evenly, or to heat a heterogenous item in the chamber with a distribution of heat tailored to treat different portions of the item differently. FIG. 5 includes two photographs, 500 and 510, of the inside of an electronic oven with 19 reflective elements. In the photographs, the oven has been augmented with an array of RF-responsive LEDs that emit light when they are bombarded with electromagnetic energy. The brightness of the LEDs therefore provides a proxy for evaluating the distribution of electromagnetic energy in the chamber. As seen, the distribution of energy is quite different in the two photographs, and the difference in the distribution of hot spots 520 between the two patterns is complex. In a basic implementation in which the microwave energy source is unchanging, and the 19 reflective elements can each only be assigned to one of two positions, the number of potential distributions of energy would still exceed half a million unique distributions.

Arrays of varying distributions and numerous elements can be applied to maximize the flexibility of the control system. For example, elements in the array could be placed at the center of every square inch on a wall of the electronic oven. Numerous other examples of distributions and relative locations of the elements to the energy source can be applied. The array could be a straight array or a hexagonal array. The array does not need to be regular. The array could be two dimensional. The array could be both two dimensional and irregular. The array can also be interrupted to accommodate other features of the electronic oven. For example, the array could be a uniform 5×5 array, but specific units in the array could be omitted to form space for a waveguide impression in the chamber surface, a mode stirrer connected to the same chamber surface as the elements of the array, a camera, or any other element.

The array of variable reflectance elements can be spaced with a period "P" which is set to create diffractive effects useful to alter the distribution of electromagnetic energy in the chamber. The reflection from a diffractive grating can be described by the grating equation: $P(\sin \Theta_m - \sin \Theta_i) = m\lambda$. In this equation, $\Theta_m$ is the angle of the reflected beam, $\Theta_i$ is the incident angle of the impending beam, P is the grating period, m is the diffraction order and lambda is the wavelength. For example, the wavelength of the wave of energy applied to the chamber with the shortest wavelength. Benefits accrue to approaches in which P is $\lambda/2$ or greater. Notably, different portions of the array can be activated or deactivated, as will be described below, in order to alter the grating period if the wavelength of the energy provided to the chamber is altered.

The increased ability to reflect and redistribute the inherent distribution of local maxima of electromagnetic energy in an electronic oven provides numerous benefits in terms of the ability of a controller to evenly apply heat to an item through the heating process. In addition, the same aspects allow for a controller to purposefully apply heat in an uneven manner to a heterogeneous item that requires different portions of the item to be heated to a different degree. In accordance with approaches disclosed herein, these benefits can be achieved without any moving parts. Indeed, certain approaches described herein allow for the variable spatial application of heat to an item in an electronic oven without any moving parts along the entire energy supply path from a mains supply voltage all the way to the item being heated. Furthermore, in certain approaches disclosed herein, the chamber can have a minimal set of injection ports as energy only needs to be applied to the chamber at one point. In certain approaches, the variable reflectance elements are purely reflective and do not receive any energy except through free space via the chamber. In other words, the elements only reflect energy, they do not introduce additional energy into the chamber.

The following disclosure is broken into three parts. The first portion describes different options for the general structure and relative locations of the chamber, energy source, and variable reflectance elements. The second portion provides a description of the functionality of the array of variable reflectance elements. The third portion provides a description of various options for the structure of the variable reflectance elements.

Electronic Oven Structure and Array Location

Figure 6A:
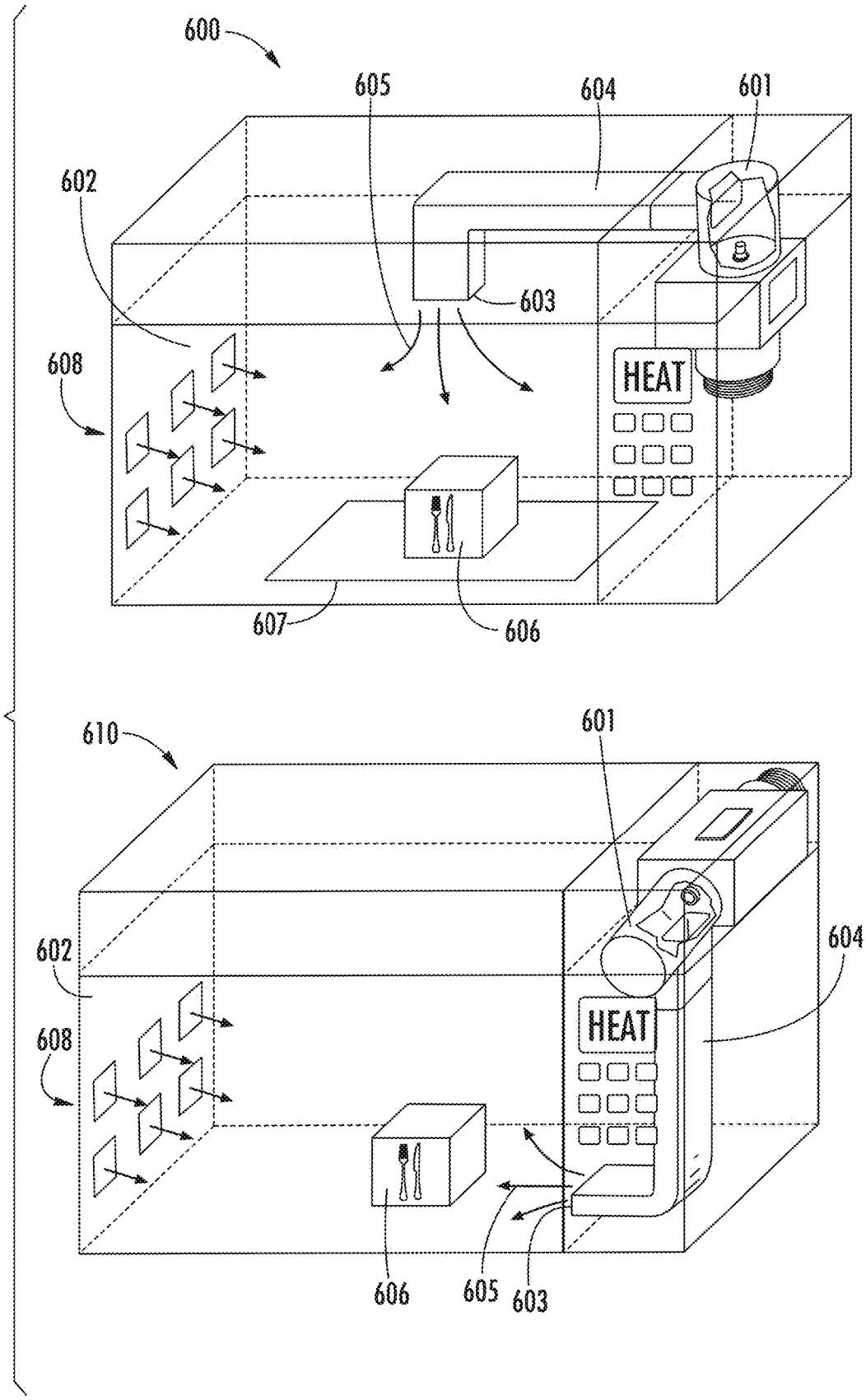
FIGS. 6*a* and 6*b* illustrate four configurations for the relative locations of an energy source and variable reflectance elements in an electronic oven.
Figure 6B:
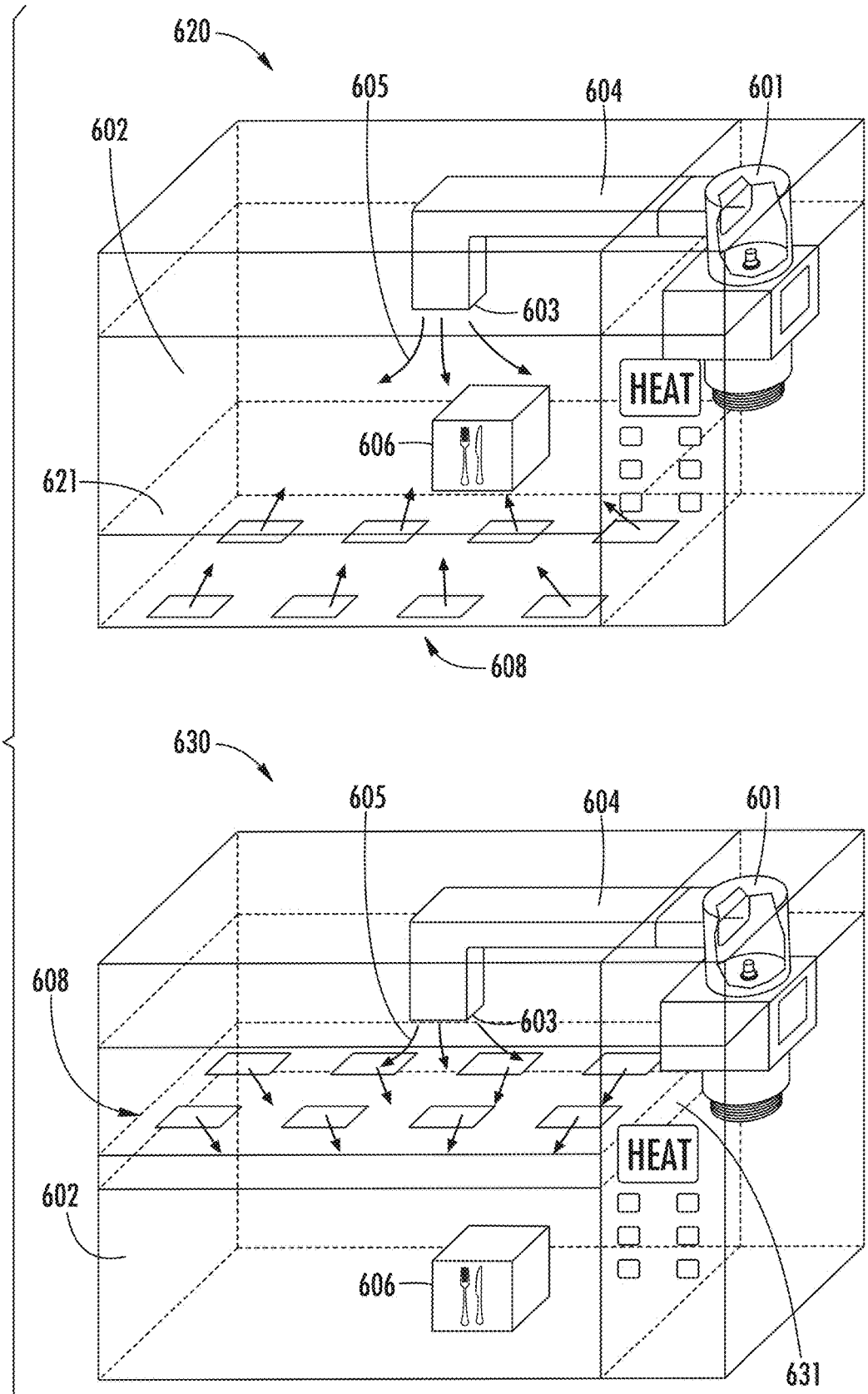

Different potential configurations for the electronic oven and array are described below. FIGS. 6*a* and 6*b* illustrate multiple configurations for the relative locations of the energy source and variable reflectance elements of the electronic oven, but numerous other configurations are possible. Like features in each of the figures are labeled with the same reference number as there are many features of the electronic oven that are common to the illustrated configurations. An implementation for mounting the array to the electronic oven, in the case of reflective elements that can be placed in different physical positions, is illustrated in FIGS. 7-10.

Each electronic oven includes an energy source 601 for supplying energy to the chamber 602. The energy source could be a magnetron and supporting power conversion circuitry that converts energy from an AC mains voltage to microwave energy. The energy source could also be a solid-state RF power generator. The chamber walls could be formed of conductive or very high dielectric constant material for purposes of keeping the electromagnetic energy in the chamber. The distribution of the energy from the energy source in the chamber could create a distribution of electromagnetic energy 605 of local maxima and minima within the chamber. These local maxima and minima could correspond to antinodes and nodes formed by standing waves of electromagnetic energy in the chamber.

The microwave energy could include a wave of electromagnetic energy provided to the chamber. The wave could be a polarized electromagnetic wave having a wavelength and a polarization. The microwave energy could have a frequency of 915 MHz or 2.45 GHz. However, the frequency of the microwave energy could be variable. The frequency variance could enhance the beam steering capabilities of the electronic oven because the same phase shift would produce a different spatial change to the distribution of energy based on the frequency of the energy applied to the chamber. Since frequency is proportional to wavelength, the same phase shift in radians would produce a different spatial shift in meters.

Energy is provided along an energy path from energy source 601 to item 606. Each electronic oven includes an injection port 603 located on a first surface of chamber 602. Energy source 601 applies energy to chamber 602 via the injection port 603. In other words, injection port 603 is located on the energy path from energy source 601 to item 606. The energy path could also include a waveguide 604 that connects the output of energy source 601 to the injection port 603. The waveguide could be a traditional waveguide for electronic ovens or a coaxial cable. The injection port could be connected to an antenna housed within the chamber. The antenna could be a monopole, dipole, patch or dual patch antenna. The injection port could be on the ceiling, floor, or sidewalls of the electronic oven. The energy path also includes the transmission of energy through the chamber to a set of variable reflectance elements 608 located in chamber 602. The energy path also includes the reflectance of that energy off of the set of variable reflectance elements to item 606. However, the relative location of the array, energy source, and item are variable based on the particular configuration selected.

In certain approaches, the energy path involves no moving parts. Energy source 601 and set 608 could have fixed physical configurations relative to the electronic oven such that they did not change either their shape or location relative to the electronic oven at any time. Set 608 could be an array of variable reflectance elements coupled to an array of solid state devices with variable impedances as described below. Although the energy path does not need any movable pieces, the electronic oven overall could still include movable pieces to help redistribute heat. For example, the electronic oven could include a tray 607 to hold item 606. The tray could be configured to move in a circular or up/down and lateral fashion such that both the applied energy and the item altered their spatial position through time. Alternatively, tray 607 could have a fixed physical configuration relative to the electronic oven. The tray would not be used to adjust the location of local maxima in the energy in this approach, but would instead simply be used to make the item easier to remove from the oven or to make the chamber easier to clean in the case of spillage from or melting of the item.

In other approaches, each of the elements of set 608 will involve moving parts. Each element in the set could be a variable reflectance element that can be set in various positions to alter the orientation of the element with respect to the polarization of an incident electromagnetic wave. For example, each variable reflectance element could be configured to rotate between a set of fixed positions such as one in which the orientation was parallel to the polarization of the incident wave and one in which the orientation was perpendicular to the polarization of the incident wave. Specific examples of this approach are described in more detail below.

In each of the illustrated approaches in FIGS. 6*a* and 6*b*, energy is only applied to the chamber via a single injection port. As such, the chamber 602 does not receive any microwave energy besides the microwave energy from injection port 603. As illustrated, the chamber 602 includes set of variable reflectance elements 608, but the elements are non-radiative. That is, the elements are not independent antennas that radiate additional energy into the chamber and serve as cumulative energy sources. Instead, the elements of set 608 merely reflect energy from energy source 601. As a benefit of this approach, the chamber does not need to have additional injection ports in order for the elements of the array to act as radiative elements and broadcast their own power from an external source into the chamber. In other approaches mentioned below the chamber will include more than one injection port. However, even in these approaches, each individual variable reflectance element does not need to be associated with an injection port that is used to inject microwave energy into the chamber.

The electronic oven could include numerous features that provide convenience for the operator. For example, the electronic oven could include a shielded door or slot for inserting item 606 into chamber 602. The electronic oven could also include a control system, control panel, and other components, located within or on the surface of the electronic oven but outside chamber 602.

A first potential configuration for the electronic oven is illustrated by electronic oven 600 in FIG. 6. Electronic oven 600 includes item 606 in chamber 602. The oven also includes an injection port 603 in a first wall of the chamber. In this approach, the injection port is on a roof of the chamber. Electronic oven 600 also includes a set of variable reflectance elements 608 on a wall of chamber 602. In the case of electronic oven 600, set 608 is placed on a single side wall of the chamber. However, the set could extend across the corner of the chamber and span multiple side walls. The chamber 602 could also include separate sets spaced apart on a single or multiple side walls. Certain benefits accrue to approaches in which the sets are placed on a wall of the chamber where the inherent distribution has a maximum or at least a local maximum. In these configurations, the efficacy of the steering mechanism is maximized because a larger proportion of the energy in the chamber is controlled by the state of the devices in the array. A related configuration is illustrated by electronic oven 610 in which injection port 603 is located on a side wall of chamber 602, opposite of the side wall on which the set 608 is located. This approach may exhibit certain benefits in that the energy from the injection port 603 is primarily directed at both item 606 and set 608.

Another potential configuration for the electronic oven is illustrated by electronic oven 620 in FIG. 6*b*. In electronic oven 620, energy is again applied from the top of electronic oven 620 on a ceiling of chamber 602 down at item 606. However, in this configuration set 608 is located behind a false floor 621 of the chamber. False floor 621 could have the appearance of the other walls of the chamber and could provide structural support, but would be transparent to the electromagnetic energy introduced to the chamber. If tray 607 is included in this configuration, it could likewise be formed of material transparent to the electromagnetic energy from energy source 601.

In specific approaches, the false floor will be spaced apart from the actual bottom surface of the chamber to assure that item 606 is within a near field of the wave reflected from set 608 and/or the bottom surface of the chamber. For example, the false floor could be positioned to be less than 0.159 of the wavelength of the shortest electromagnetic waves applied to the chamber from the bottom surface of the chamber. In other approaches, the set 608 can be variable reflectance elements spaced apart from the bottom surface of the chamber and the false floor could instead by positioned to be less than 0.159 of the wavelength of the shortest electromagnetic waves applied to the chamber from the variable reflectance elements. In either case, the stated distance is a vertical distance measured perpendicular to the false floor. These approaches can exhibit certain beneficial aspects in that the near field of the wave can be more easily controlled by set 608. This is because the disturbances introduced by a reflective element have a greater impact on the distribution of energy in the near field as compared to further from the elements. An additional benefit of utilizing a false floor such as false floor 621 is that item 606 is lifted off the actual bottom of the chamber where the electromagnetic distribution in the chamber tends towards zero.

Another potential configuration for the electronic oven is illustrated by electronic oven 630 in FIG. 6*b*. In electronic oven 630, energy is again applied from the top of the oven via the injection port 603 on a ceiling of chamber 602. However, in this approach, the energy introduced to chamber 602 is immediately confronted by set of variable reflectance elements 608 which is spaced vertically in the direction of item 606 from the ceiling of the chamber. As such, set 608 can be placed behind a false ceiling 631 of the chamber which could also serve as the substrate for set 608. An alternative potential configuration is to have the array embedded on the ceiling of chamber 602. However, the illustrated approach behaves differently in that the energy passes through the array before it reaches the chamber in the first instance. As a result, the array can serve to focus the energy in the form of Fresnel or zone plate focusing. This approach, with an aligned and proximate injection port and set of variable reflectance elements that are in the immediate vicinity of the injection port, could be built into the floor or any sidewall of the chamber instead of the ceiling. In other words, the injection port could be located on the bottom of the chamber, and the set of elements could be positioned as in electronic oven 620. In addition, this approach could be utilized with multiple injection ports on multiple sides of the chamber with accompanying arrays of variable reflectance elements on those multiple sides for Fresnel focusing.

FIG. 7 provides a plan view 700 of the front side of a printed circuit board 701 along with an isometric view 710 of the back side of the printed circuit board 701. Printed circuit board 701 is configured to be mounted to an electronic oven such that the array of variable reflectance elements 702 can serve as the set of variable reflectance elements 608 in FIGS. 6*a*-6*b*. The printed circuit board in the illustrated case is in a u-shape. However, the printed circuit board can take on any other shape depending upon the pattern of variable reflectance elements used. The front side of the printed circuit board 701 includes power regulation circuits 703 and control logic circuits 704. The control logic circuits 704 can be ARM processors or equivalents. The front side of the printed circuit board also includes multiple drive motors 705 which can exhibit the same features as drive motor 312 from FIG. 3. The drive motors can each individually rotate a corresponding variable reflectance element in array 702 based on instructions provided from control logic circuits 704 and stored on those logic circuits.

FIG. 8 provides two detailed views of an individual variable reflectance element 801 in array 702. In view 800, the reflective element is shown on PCB 701 with motor drive shaft 802 mated to drive shaft connection cylinder 303 of dielectric spindle 201. Drive shaft 802 can be part of a drive motor and may be made of metal. The PCB is then mounted in such a way that the drive shaft 802 does not extend into the chamber of the electronic oven, and only the thicker portion 803 of the dielectric spindle extends into the chamber.

View 810 provides an example of how the dielectric spindle could be positioned with respect to the chamber of the electronic oven. The spindle could extend through a perforation 811 in a surface of the chamber 812. The perforation could be punched in the surface of the chamber or formed by laser cutting. The perforation could be made small enough that a tight seal was formed with dielectric spindle 803 to avoid any energy leaking out of the chamber. The fact that the dielectric spindle is thicker above the point at which it extends into the chamber further assists in assuring that energy does not leak from the chamber. The length of the thick portion of the dielectric spindle would then set the distance at which the reflective element of the variable reflectance element was held off from the surface of the chamber.

Figure 9:
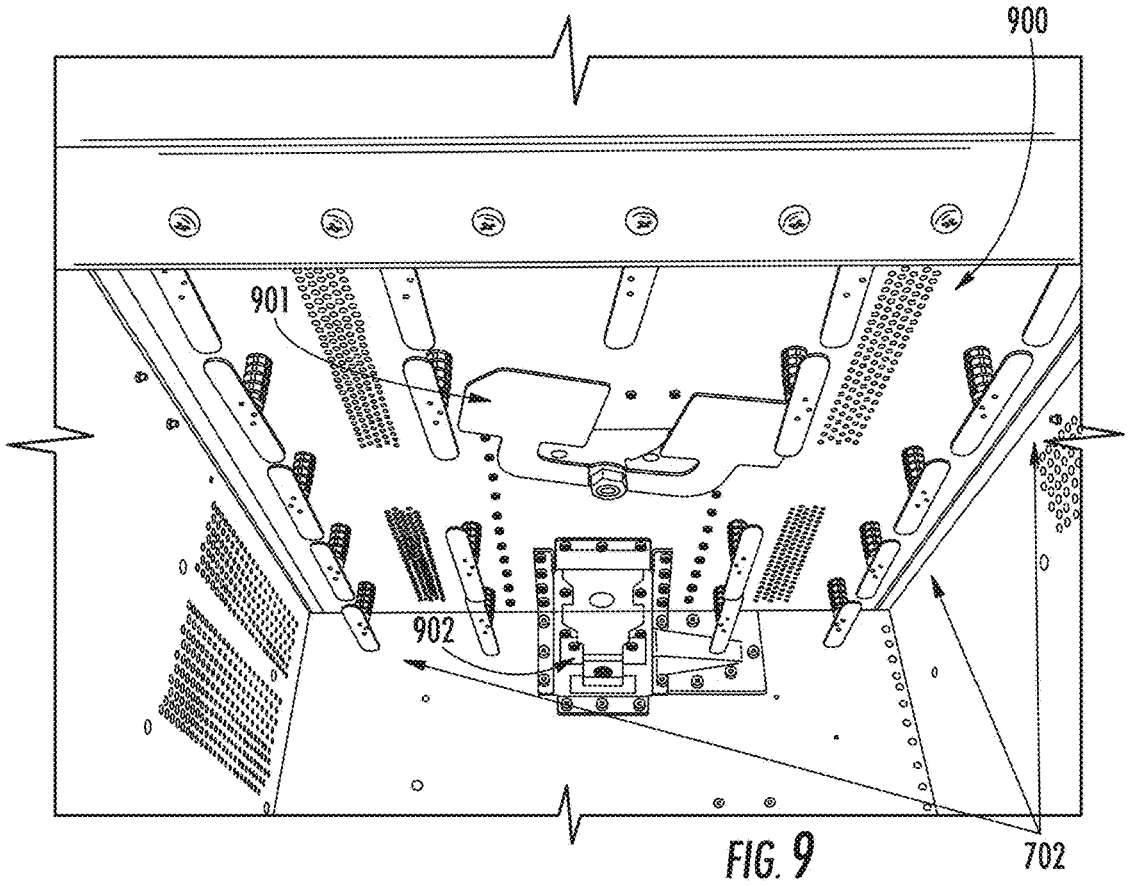
FIG. 9 illustrates the ceiling of an electronic oven with a set of variable reflectance elements and a traditional mode stirrer located on that surface of the chamber of the electronic oven.
Figure 10:
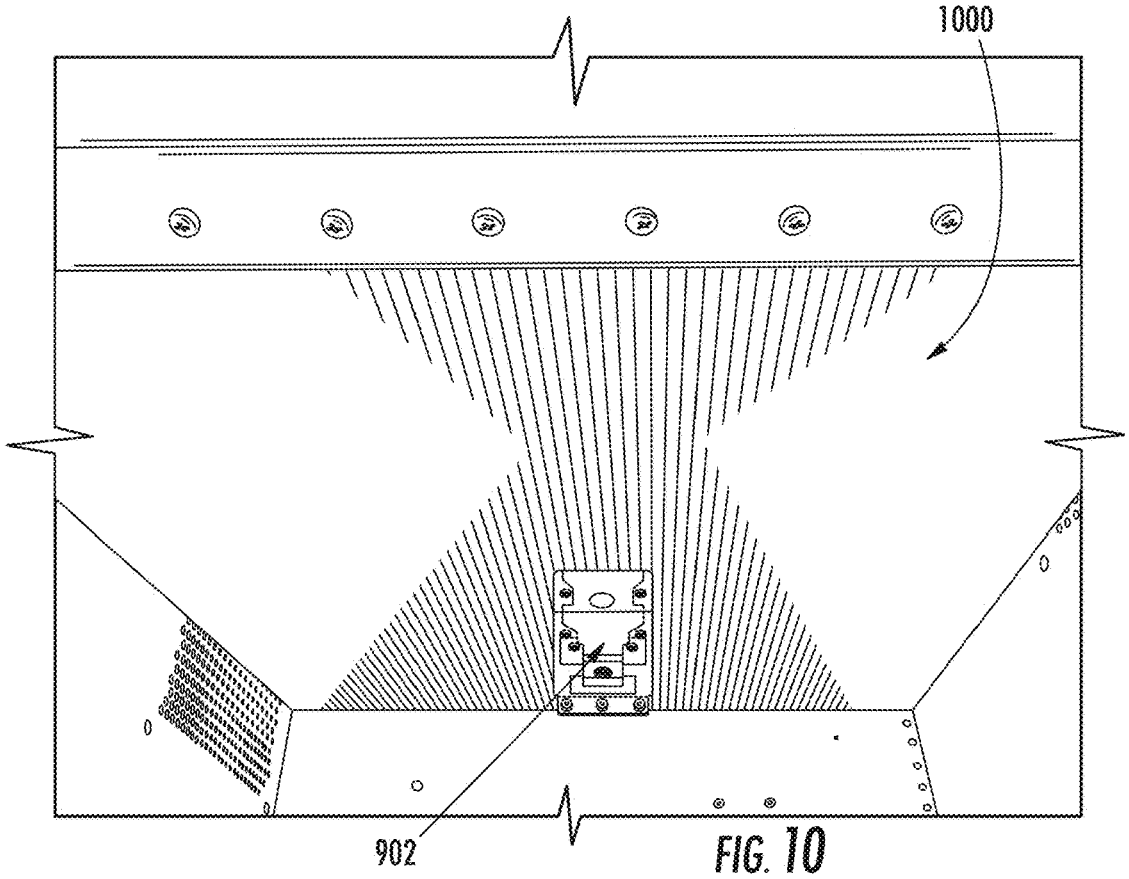
FIG. 10 illustrates the same view as FIG. 9 with the additional of an RF-transparent plastic cover to conceal and protect the variable reflectance elements.

FIG. 9 provides a view of the set of reflective elements 702 once PCB 701 is mounted to the electronic oven. The view is from the bottom of the chamber of the electronic oven looking up at the ceiling of the chamber. The thick portion of each dielectric spindle and the reflective elements are seen extending through perforations in surface 900. PCB 701 is set off from the chamber such that the thick portion of each dielectric spindle nearly rests on surface 900. Antenna 901 is a dual patch antenna and is coupled to an injection port in the chamber. FIG. 10 is the same view of the chamber with a false ceiling 1000. The false ceiling could be made of plastic such as polypropylene or some other material that is transparent to microwave energy. The antenna and set of reflective elements are not visible because they are positioned behind false ceiling 1000 such that they are shielded from splatter or other interference.

The reflective elements can be held above a surface of the chamber at a specific distance that depends on the wavelength of the electromagnetic energy and is selected to maximize the interference introduced by the reflective elements. As shown, the surface of the reflective elements defines a plane that is offset from the surface of the chamber. The vertical spacing as measured perpendicular to the surface of the chamber and the false ceiling is less than 0.6 of the wavelength of the shortest electromagnetic wave introduced to the chamber. In the approach illustrated by FIG. 9 the plane defined by the surface of the reflective elements is approximately 25 mm from the surface of the chamber which equates to a distance of roughly a quarter wavelength for the electromagnetic energy for which the electronic oven of FIG. 9 is designed to receive. The spacing is selected to maximize the interference caused by the variable reflectance elements with the electromagnetic energy introduced to the chamber and therefore the variability of the patterns of electromagnetic distribution in the chamber available to a control system for the electronic oven. The specific distance at which the reflective elements are held off from the wall of the chamber can be variable if the electronic oven is designed to introduce electromagnetic waves of different frequencies into the chamber. The drive shafts can be mechanically extendible to allow for this effect.

As illustrated, the antenna is likewise spaced off from the surface of the chamber. In the approach illustrated by FIG. 9, the antenna is approximately 13 mm from the surface of the chamber. However, this spacing is set by the geometry of the antenna and is generally independent of the optimal spacing for the reflective elements. As such, the fact that the spacing of the array can be irregular provides significant benefits from a design perspective as the array can be interrupted to provide room for the antenna if it happens that the antenna and reflective element perform best in two regions of vertical spacing that would otherwise conflict.

As mentioned previously, the set of reflective elements can be placed on any surface or surfaces of the electronic oven. However certain benefits accrue to approaches in which the reflective elements are located on the same side of the chamber as the injection port and opposite the item to be heated as in electronic oven 630. The benefit relates to the fact that most items placed in an electronic oven for heating only absorb a relatively small amount of energy on a first pass of the electromagnetic wave. For example, a cup of tea placed in an electronic oven in which energy is delivered from a ceiling injection port only absorbs 10-15% of the electromagnetic energy on a first pass, and roughly 80% of the energy is reflected back up to the ceiling. Therefore, placing the set of reflective elements on the ceiling is beneficial in that it interferes with the outgoing wave as soon as it is delivered to the chamber, and it is directly in line with a large amount of the energy as it reflects off the item. The effect continues for each subsequent reflection and is compounded by the fact that the bulk of the energy is delivered perpendicular to the plane set by the reflective elements.

In the above approaches, a single injection port was utilized to introduce energy into the chamber. However, multiple injection ports and energy sources could be utilized to introduce energy into the chamber. These alternative approaches would still be in keeping with the approaches of FIGS. 6*a* and 6*b* so long as the elements in the set were non-radiative and did not introduce additional energy to the chamber. In particular, the chamber could include two injection ports above item 606, or injection ports both above and below item 606 such that heat could be directed to the item from multiple directions. Each injection port could be connected to the same microwave energy source, such as a single magnetron, or could have its own associated microwave power supply. As before, the chamber would still not receive any microwave energy besides the microwave energy from the injection port and the second injection port.

The illustrated spacing of elements in set 608 is not exhaustive. As mentioned, the elements can be spaced in numerous ways. In particular, the set can be spaced to create a diffraction grating with a variable angle of reflection by deactivating certain elements of the array. Further, the set can be spaced so that different sub-sets or patterns can be deactivated for purposes of steering electromagnetic energy with different wavelengths. With reference to the spacing discussion above, the elements can also be spaced so that they are spaced apart by at least one half of the wavelength of the shortest wavelength of energy supplied to the chamber from the energy source. Again, the set can be configured in an array, but the array can have interrupts for features of the electronic oven such as a waveguide impression in the chamber surface, a camera, or a mode stirrer. For example, in situations in which the electronic oven included two injection ports, the array could be adjusted to provide space for two offset antennas on a ceiling of the microwave oven.

The set of variable reflectance elements can continue to provide a significant number of useful distributions of energy in the chamber despite being irregularly spaced. FIG. 9 is an example of this flexibility in that the illustrated set of reflective elements includes 19 elements in a 5×5 array with elements removed to make space for an antenna 901 and a camera 902. Increasing the density does tend to increase the flexibility of the control system, but the returns diminish and eventually drop to near zero when the spacing becomes less than one half the wavelength of the smallest electromagnetic wave introduced to the chamber. In the illustrated case of FIG. 9, the array pitch is 63 mm which was selected in light of a microwave energy source introducing an electromagnetic wave at a frequency of 2.45 GHz to the chamber, which corresponds with a half wavelength of 59 mm.

Array Functionality

Figure 11:
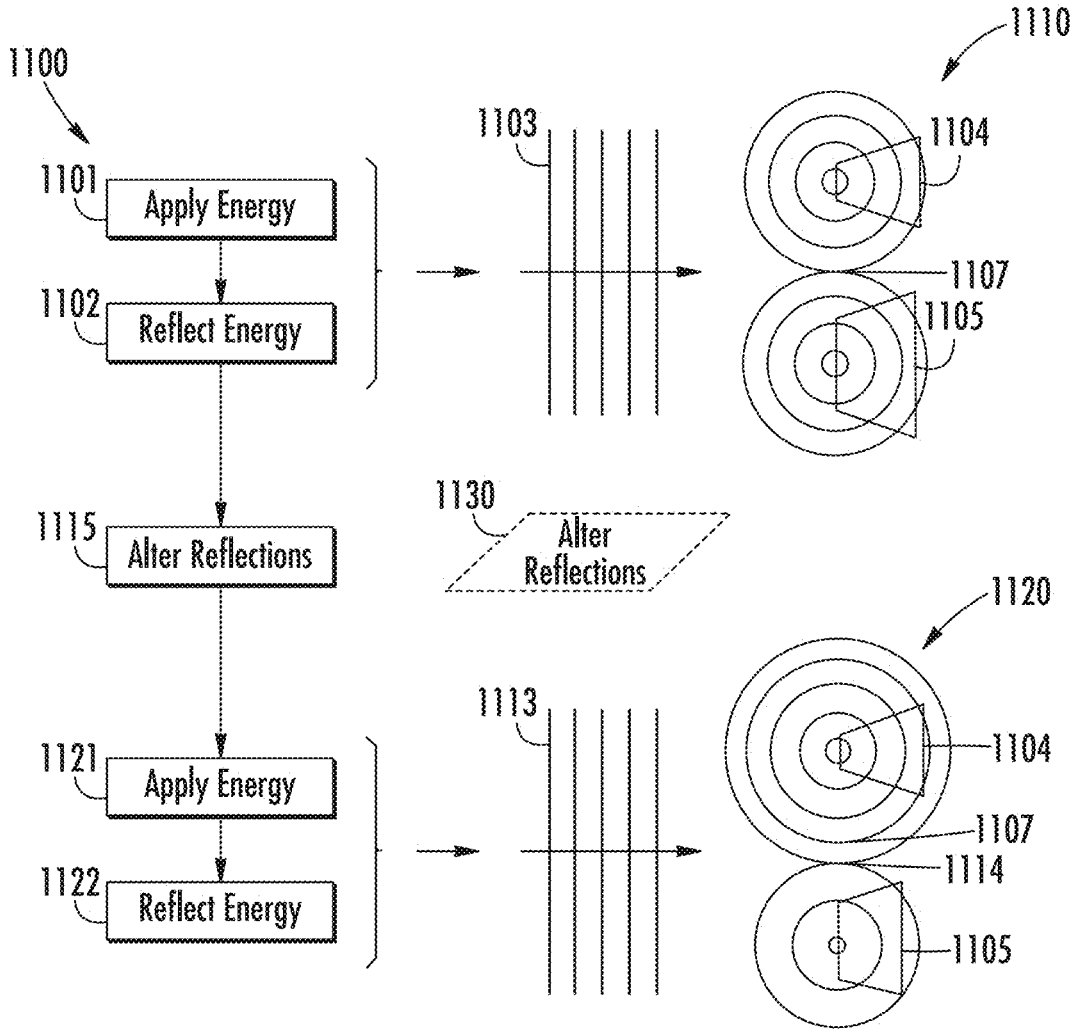
FIG. 11 illustrates a flow chart for a set of methods for heating an item in a chamber and a diagram for how two variable reflectance elements alter the location of a local maximum based on their states.

A set of methods for heating an item in a chamber can be described with reference to flow chart 1100, diagram 1110, and diagram 1120 in FIG. 11. Flow chart 1100 includes a step 1101 of applying a first electromagnetic wave to the chamber from an energy source to a set of variable reflectance elements. The methods of flow chart 1100 can be applied to the configurations described above. The set of variable reflectance elements can include a set of variable impedance devices or a set of movable reflective elements. The variable impedance devices could be solid state devices. Step 1102 involves reflecting the first electromagnetic wave from the set of variable reflectance elements to the item. Steps 1101 and 1102 are illustrated as sequential steps but they could both be occurring in a looping and/or simultaneous manner. In this sense, the electromagnetic wave could be an amount of energy produced by the energy source in an arbitrary period of time.

Diagram 1110 illustrates the first electromagnetic wave 1103 being delivered to a first variable reflectance element 1104 and a second variable reflectance element 1105. The first electromagnetic wave could be incident on the elements directly from the injection port in the chamber or could be a reflection from elsewhere in the chamber. The concentric circles radiating out from elements 1104 and 1105 represent the reflected electromagnetic energy that is produced in step 1102. Specifically, each circle represents a local maximum magnitude of reflected energy. In diagram 1110, the two elements produce patterns with identical phases such that the inner most circle of the set has the same radius. As a result, the two reflected signals combine to produce an energy distribution pattern with an antinode at location 1107. The energy distribution will include many such local maximums. In particular, the energy distribution pattern may place a local maximum of energy at a first location on the item being heated in the chamber.

In step 1115, a reflectance of one of the variable reflectance elements is altered. As used herein, the term "reflectance" is used with reference to the reflection coefficient as it is defined in the field of telecommunications. The coefficient is calculated using the impedance of the load and source at the point of reflection. It is a complex number with both a magnitude and phase. The reflectance of the variable reflectance element can be modified in numerous ways as will be described below. In particular, one way is to alter the impedance of an optional solid-state device associated with the variable reflectance element. In other words, step 1102 may be conducted when a first solid state device in the array of solid state devices has a first impedance value, and step 1115 can include altering the impedance of the first solid state device to a second impedance value. In another example, the orientation of the variable reflectance element can be altered by physically repositioning the variable reflectance element. In certain approaches, a 90° rotation of the variable reflectance element will change the phase of the wave reflected from the variable reflectance element. In other words, step 1102 may be conducted when an electrically reflective element is oriented in a first position and step 1115 can include rotating the reflective element from the first position to a second position.

Flow chart 1100 then continues to step 1121 in which a second electromagnetic wave is applied to the chamber from the energy source. The second and first electromagnetic waves can be two different portions of the same continuous supply of energy at two different times. In other words, the energy source does not need to vary in terms of the power and direction of application. Therefore, with reference to diagram 1120, the second electromagnetic wave 1113 can have the same general characteristic as the first electromagnetic wave 1103 from diagram 1110.

Step 1122 involves reflecting the second electromagnetic wave from the set of variable reflectance elements to the item. To illustrate this step, diagram 1120 again includes variable reflectance elements 1104 and 1105. As mentioned previously, second electromagnetic wave 1113 can have the same general characteristic as first electromagnetic wave 1103. However, since the reflectance of one of elements 1104 and 1105 has changed, the location of the local maximum has moved from location 1107 to location 1114. As illustrated, the change in the reflectance of variable reflectance element 1105 resulted in a phase shift in the reflectance. This is illustrated by the fact that the first local maximum of the energy reflected by element 1105 is physically closer to the center of the element. Using this approach, step 1122 can cause the location of the local maxima of the distributed energy pattern in the chamber to alter their locations. In particular, the location of a local maximum on the item being heated can be altered from a first location to a second location where the first and second locations are different.

In diagram 1120, where the reflectors are ideal point reflectors and do not involve moving parts, the location of local maxima could at most be modified by up to one wavelength. However, if the reflectance of multiple variable reflectance elements in the array can be modified, then the local maxima can be moved with a much greater degree of flexibility. In a basic example, flow chart 1100 could include step 1130 in which the reflectance of a second variable reflectance element is modified. The step is shown in phantom because it could be conducted before, after, or simultaneously with step 1115. Depending upon the control system that is configured to interface with the variable reflectance elements, the variable reflectance elements in the array could each be modified independently, they could be modified in groups, or they could be modified in an interrelated manner. For example, element 1104 could have its reflectance altered at the same time as element 1105 but with a phase change in the opposite direction to double the effect of the modification.

The reflectance of each variable reflectance element can be changed in different ways depending upon the application. For example, the reflectance could be adjusted such that the phase of the reflectance was tuned continuously between 0° and 180° by steps, such as steps of one degree, or could be hard switched to specific values such as 0°, 90°, and 180°. In addition, both the phase and magnitude of the reflectance could be altered. Each variable reflectance element could be associated with a variable impedance device to provide the associated variation in reflectance. In particular, each variable reflectance element could be associated with a solid-state device such as a PIN diode or FET to provide the associated variation in reflectance. Using the example of a FET, the voltage on the control gate could be swept continuously between two voltages to alter the impedance of the load that sets the reflectance coefficient. Again with reference to the FET example, the voltage could be switched between a lower and upper reference voltage to turn the FET all the way on or off to alternatively connect the main body of the variable reflectance element to another circuit node or keep it floating. Using the example of an electrically reflective element that can be moved to various positions, the phase and magnitude of the reflectance can be altered by altering the orientation of the element with respect to the polarization of the incident wave. The element could be configured to switch between physical positions separated by variable step sizes that correspond to desired changes in the phase of the reflectance. Alternatively, the electrically reflective element could be moved to various fixed positions according to a regular pattern such as by rotating in a circle by 10°, 45°, or 90° intervals. The controller could be configured to rotate the element and keep track of its current position value by summing the number of fixed rotation steps taken. Alternatively, the controller could be configured to rotate the element to certain fixed locations and keep track of its current position directly by storing the fixed value to which the element was moved.

Figure 12:
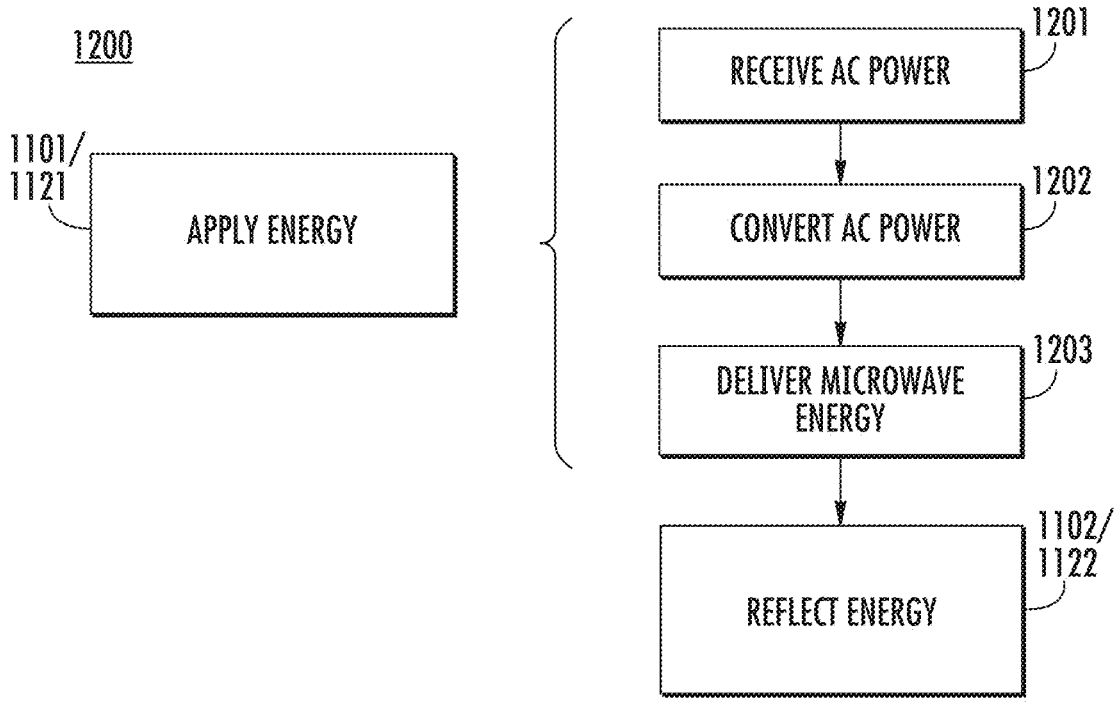
FIG. 12 illustrates a flow chart for a set of methods for executing one of the steps in FIG. 11.

FIG. 12 illustrates a flow chart 1200 for a set of methods that can be utilized to execute method steps 1101 and 1121 in flow chart 1100. Flow chart 1200 begins with step 1201 in which AC power is received from an AC mains voltage source. This step can be conducted by energy source 601 operating in combination with optional power conditioning and conversion circuitry. The term AC mains voltage source is meant to include all worldwide standard AC voltages and frequencies including the standard 120 V at 60 Hz AC mains voltage source utilized in the United States.

Flow chart 1200 continues with step 1202 in which the AC power is converted to microwave energy. This step can be conducted using a magnetron in energy source 601. The step can be conducted by numerous other power conversion options such as through the use of inverter technology and the use of solid state devices. As such, the frequency, amplitude, and polarization of the microwave power can be varied through a single heating session. Step 1202 can also include the use of multiple microwave energy converters in a single electronic oven.

Flow chart 1200 continues with step 1203 in which microwave energy is delivered to the chamber via an injection port in the chamber. The microwave energy generated in step 1202 can be delivered to the injection port using a waveguide from the microwave converter to the injection port. The injection port and waveguide could be elements 603 and 604. The energy could also be channeled to multiple injection ports in the chamber using multiple waveguides. These approaches could be combined with those in which multiple microwave converters were utilized in step 1202.

Flow chart 1200 then returns to step 1102 or 1122 in flow chart 1100 where the applied energy is reflected from the set of variable reflectance elements. The set of variable reflectance elements only receives microwave energy via the chamber from energy generated by the energy source. For example, in situations where the energy source is a magnetron, the magnetron generates all of the microwave energy that will be delivered to the chamber, and delivers all of it via the injection port, or ports, in the chamber. In other words, additional waveguides do not provide power to the elements of the array of variable reflectance elements. In these approaches, the chamber does not receive any microwave energy besides the microwave energy from the injection port. Therefore, the elements of the array of variable reflectance elements are non-radiative elements. There is no way for the elements to radiate energy into the chamber, they only reflect energy provided to the chamber.

Set Composition

The set of variable reflectance elements in the chamber can be arranged as an array, or arrays, with various characteristics in order to serve their purpose in varying the phase of the energy they reflect and thereby virtually resize the chamber. Each variable reflectance element in a set of variable reflectance elements could correspond with a variable impedance device. Each variable reflectance element in a set of variable reflectance elements could correspond with an electrically reflective element. In certain approaches, each variable reflectance element in an array of variable reflectance elements could uniquely correspond with a variable impedance device. The variable impedance devices could be solid state devices. The variable reflectance elements may include a reflective element that is attached to a wall of the chamber using a conductive or insulating support. The reflective element can be formed of sheet metal. The reflective element could be connected to either a ground plane or another variable reflectance element via a variable impedance device. The variable impedance devices could be located on a wall of the chamber. For example, the variable impedance devices could be located on a PCB on a wall of the chamber, or could be housed in a structure connecting the body of the variable reflectance element to the wall. The ground plane could be a wall of the chamber or a metal layer on a printed circuit board. The metal layer could be copper.

As mentioned previously, the reflectance of the variable reflectance elements can be altered to adjust the phase of the reflected energy. The reflectance could be adjusted in response to a control system located in or on the electronic oven. To this end, the variable reflectance elements can be altered from a first state to a second state. The variable reflectance elements can be defined by binary states and serve as digital tuners for the reflected energy or may be able to transition continuously between a large number of states and serve as analog tuners for the reflected energy. For example, the phase shift introduced by each variable reflectance element could be from 0° to 90° and back, or could be anywhere from 0° to 180° with a smooth transition between each gradation on the spectrum. As another example, the orientation of each variable reflectance element with respect to the dominant polarization of an incident electromagnetic wave could be changed from 0° to 90° and back, or could be anywhere from 0° to 180° with a smooth transition between each gradation on the spectrum. Notably, even in the binary case, the variable reflectance element is only one element in a set, so the number of elements can be increased to provide flexibility to the control of the reflected energy despite the fact that each individual element only has two states.

The controller could be designed to store the state of each variable reflectance element in order to make that data available to a higher-level control system tasked with determining the optimal distribution of energy in the electronic oven at any given time. The value could be stored after each adjustment so that a current state value was updated after each action that changed the state of the element. In the particular example of a variable reflectance element with an electrically reflective element that changed its physical position, the controller could store a corresponding current position value independently for each reflective element in the set of reflective elements used in the chamber. The controller could then also store instructions that alter the corresponding current position values in response to a movement, such as a rotation of, the set of reflective elements. For example, if the variable reflectance element was undergoing a change in position from a first position to a second position, the current position value could be changed from a value corresponding to the first position to a value corresponding to the second position. In order to accurately track this information, each action taken by the controller would need to be carefully undertaken to assure that the stored value for the state of the variable reflectance element accurately reflected the real-world state of that element. Alternatively, the mechanism for setting the state of the variable reflectance elements could be designed to be tracked easily such that a single stored variable could reflect its current state. In the specific example of an element positioned by an actuator such as drive motor 312, the position of each actuator could be a variable at a memory location in RAM. The memory location could be accessible to or readable by the actuator. Adjusting the position of the element would then involve writing a new value to that memory location, and allowing the actuator to access the memory location and move the element to the new location.

As stated previously, the controller could be control logic such as ARM processors located on a circuit board in the electronic oven, and the position of a reflective element could be set by a gauge motor that receives instructions from the control logic via the circuit board. In approaches in which the reflective elements are formed by thin sheet metal aluminum, the low torque provided by gauge motors would not be an issue because of the light weight of the reflective elements. Furthermore, gauge motors are designed to receive instructions to reliably rotate to a specific location such that the controllers can easily keep track of what position each reflective element has been rotated to. This feature would facilitate the operation of the overall control loop for the electronic oven.

The potential states for the electrically reflective elements could be stored ex ante by the controller and recalled when the controller was operational. For example, a set of fixed positions could be stored for an electrically reflective element that was configured to alter its position such as "at 90°" or "at baseline." The controller could then recall these values and implement them using a motor when it was time to place the variable reflectance elements in a given condition.

In certain approaches, to avoid unwanted absorption or dissipation of the microwave energy in the variable reflectance elements, the variable reflectance elements are designed to have a substantially reactive impedance at the frequency, or frequencies, of energy applied by the energy source. This ensures that the incident energy is effectively reflected and used for heating the item, rather than causing unwanted loss or heating in the variable reflectance elements themselves. In certain approaches, this will involve maintaining the low impedance state of any variable impedance devices needed to alter the state of their associated variable reflectance elements at an impedance less than 1Ω.

Additionally, certain steps can be taken to assure that the variable reflectance elements do affect the amplitude of the reflected energy. In certain approaches, it may be beneficial to allow the variable reflectance elements to absorb energy and pull it out of the chamber via one or more of the variable reflectance elements in order to achieve balance in the chamber. For example, a subset of variable reflectance elements may include a variable impedance device that wires the variable reflectance element to an injection port in the chamber wall. The variable impedance device could exhibit a high impedance to energy at the frequency of the energy applied to the chamber in a neutral state, but exhibit a low impedance at that same frequency when it was time for the associated element to remove energy from the chamber.

The reflectance of the variable reflectance elements can be altered to modify the characteristics of the chamber in order to accommodate different frequencies for the energy applied to the chamber. In some approaches, the frequency of the energy applied to the chamber will have an appreciable effect on how that energy responds to the variable reflectance elements. For example, an array that is configured to tune energy delivered at a first frequency in order to move a local maximum of the distributed pattern of energy 10 cm in any direction will be unable to move a local maximum more than a single cm at a second frequency. As a result, the array will be unable to appreciably alter the position of the local maxima to achieve even heating in the electronic oven. To alleviate this problem, different arrays can be formed in the chamber to deal with different frequencies of applied energy. The different arrays can be subsets of each other where the unused elements of one array are locked at a neutral state when the second array is operating. The neutral state could be set to mimic the reflectance of the bare wall of the chamber at the current frequency of applied energy, or could be set to perfectly reflect all energy with zero change in the phase or magnitude.

In certain approaches, the set of variable reflectance elements can include a set of electrically reflective elements that physically alter their position. For example, the variable reflectance elements could include a reflective element that is held above a surface of the chamber by a dielectric support. The reflective element could be formed by sheet metal. The dielectric support could be a dielectric spindle used to rotate the reflective element. Rotation could be conducted around a central axis normal to a wall of the chamber or parallel to a wall of the chamber. The axis could also be offset from the chamber wall at a different angle.

Figure 13:
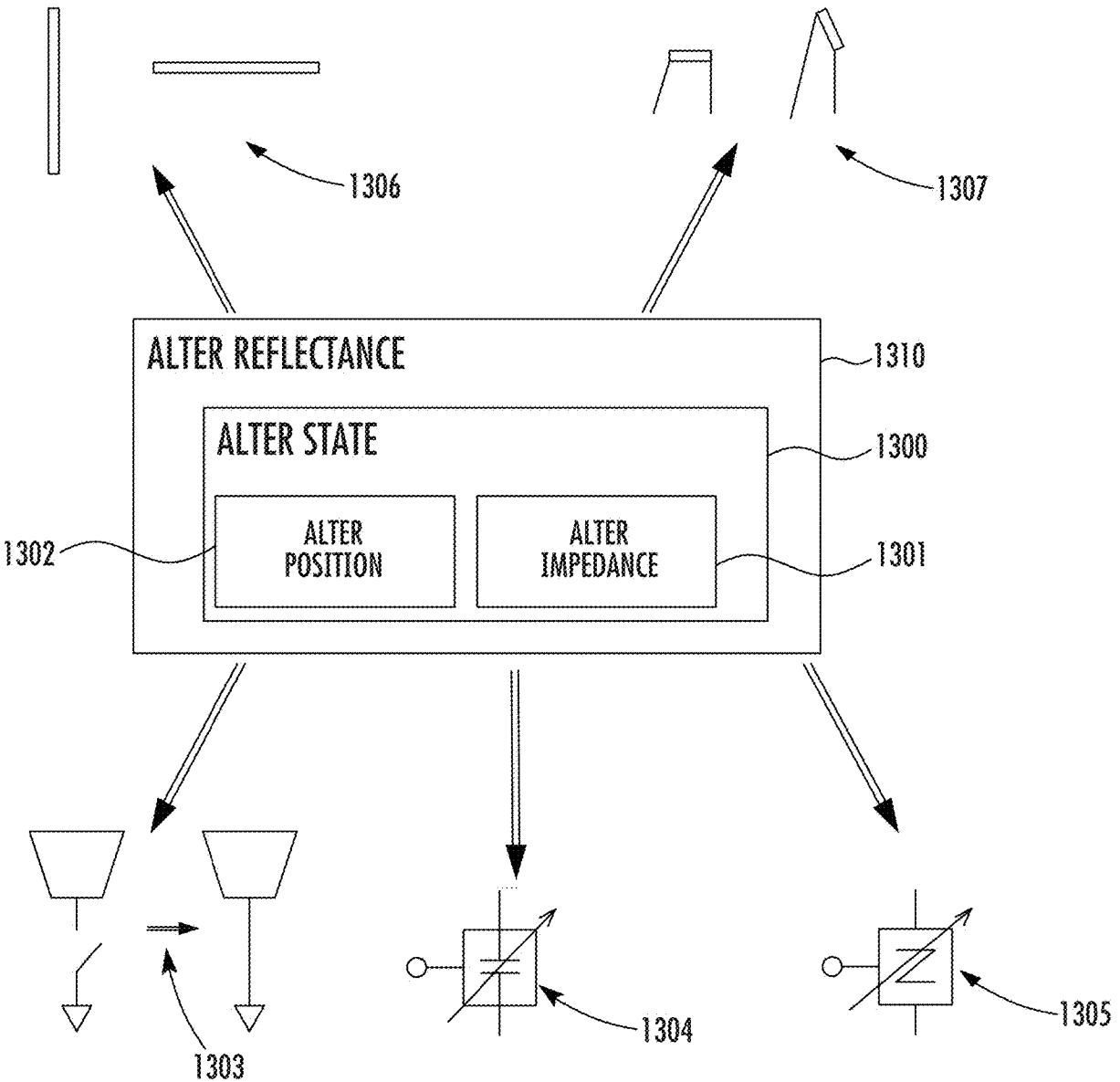
FIG. 13 illustrates a flow chart for a set of methods and block diagrams for executing one of the steps in FIG. 11.

FIG. 13 illustrates block diagrams that provide an explanation of how step 1115 can be conducted in accordance with the description provided immediately above regarding the variable reflectance elements. In step 1300, a variable reflectance element is altered from a first state to a second state. These two states could describe all of the states that the variable reflectance element could exhibit, or they could be two from among multiple states. In step 1301, an impedance of a variable impedance device is altered. The variable impedance device could correspond with the variable reflectance element and could correspond with the variable reflectance element uniquely. In step 1302, a physical position of a variable reflectance element is altered from a first position to a second position.

FIG. 13 includes block diagrams of specific ways in which step 1301 could be executed. In diagram 1303, a variable reflectance element body is left floating in one state and is connected to ground in a second state. As a result, the time it takes charge to flow from one end of the device to the other is altered and the phase of the reflectance will change. In another approach, illustrated by reference number 1304, the variable impedance element is a varactor and the change in capacitance alters the phase of the reflected energy. The approach illustrated by reference number 1305 expands this concept to indicate that any complex impedance can be made variable to alter the reflectance of the variable reflectance element. More specific examples are provided below with respect to FIGS. 14-20. In diagram 1306 of FIG. 13, a variable reflectance element comprises an electrically reflective element that is rotated 90° to change its orientation with respect to the polarization of an incident wave of electromagnetic energy. The axis of rotation in this case is normal to a wall of the chamber such that diagram 1306 is a plan view of that wall. In diagram 1307, a variable reflectance element comprises an electrically reflective element that is fixed on one end and rotated by extending a support connected to an opposite end. More specific examples are provided below with respect to FIGS. 21-22.

The body of the variable reflectance elements can be configured in accordance with the structure utilized for various types of antennas. For example, patch, dipole, monopole, slot, or split ring resonator antenna structures could be employed to form the body of the variable reflectance elements. However, the use of additional physical structures associated with radiative devices would generally not be needed. In a specific example, the variable reflectance element could be a monopole reflector with an optional connection to ground via a variable impedance device. In another example, the variable reflectance element could be configured as a single portion of two adjacent monopoles in a bowtie configuration with a variable impedance connection between the two halves. In this approach, a single variable impedance device would adjust the reflectance of two variable reflectance elements by isolating them in one state and wiring them together in another state. The array may include a mix of different structures for its composite elements such as a mix of monopoles and dipoles in a repeating pattern.

The variable reflectance elements could be configured to operate in two or more states. One of those states could involve the body of the device floating and another state could involve the body being wired to ground. Alternatively, one of those states could involve the body of the device floating and another state could involve the body being wired to another variable reflectance element. In a still further approach, the device could exhibit more than two states and those states could include being left floating, being wired to a ground plane, and being wired to one or more other variable reflectance elements. To compound the number of states each element can exhibit, an associated variable impedance device used to transition the device between these various states could itself exhibit more than two states. In other words, the variable impedance device could isolate the body of the variable reflectance element, wire it to another node, or connect it to a node via an intermediate impedance.

Figure 14:
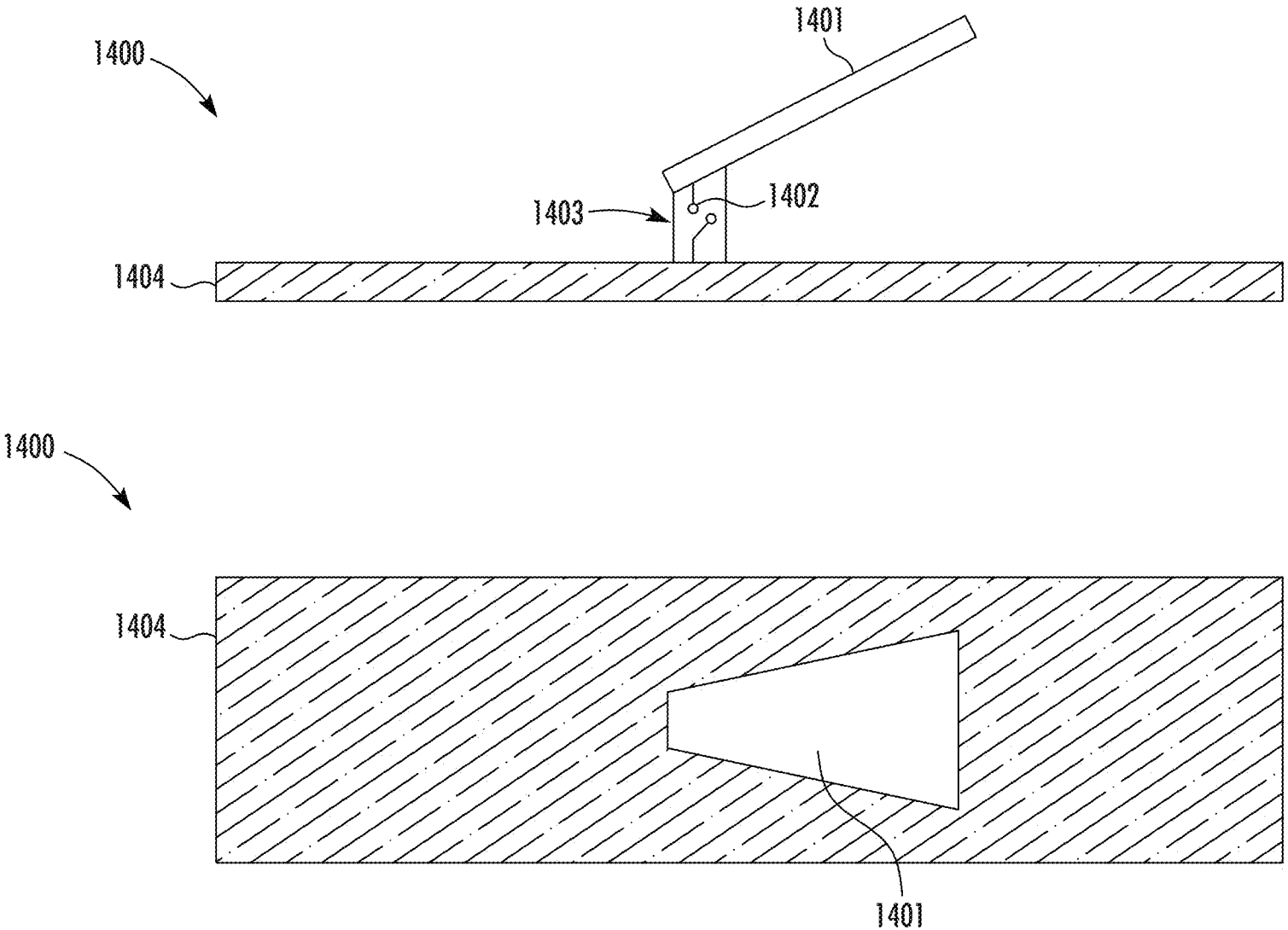
FIG. 14 illustrates a variable reflectance element from a side view and a plan view.

FIG. 14 illustrates an example variable reflectance element 1400 both from a side view (top image of FIG. 14) and plan view (bottom image of FIG. 14). Element 1400 alters a phase shift provided by the device by alternatively floating or being wired to a ground plane. Element 1400 includes a body 1401 in the shape of a monopole antenna and a variable impedance device 1402 embedded in a support structure 1403. The support structure is connected to ground plane 1404. The ground plane could be a wall of the chamber or a conductive layer on a printed circuit board that is placed on the wall. Variable impedance device 1402 could be a switch such as a PIN diode or FET. The switch could alter between two states which would likewise cause the variable reflectance element 1400 to alter between two states with different reflectance. In a first state, the switch would be open and have a high impedance, and the body 1401 would be floating. In a second state, the switch would be closed and have a low impedance, and the body 1401 would be wired to ground plane 1404. Ground plane 1404 could be specific to device 1400 or it could be shared by multiple variable reflectance elements. An element with the same configuration could also exhibit multiple phase shifts if an impedance of variable impedance device 1402 could be gradually modified. The device could also be modified to have multiple associated variable impedance devices that could connect the body of the device to the ground plane at different locations.

Figure 15:
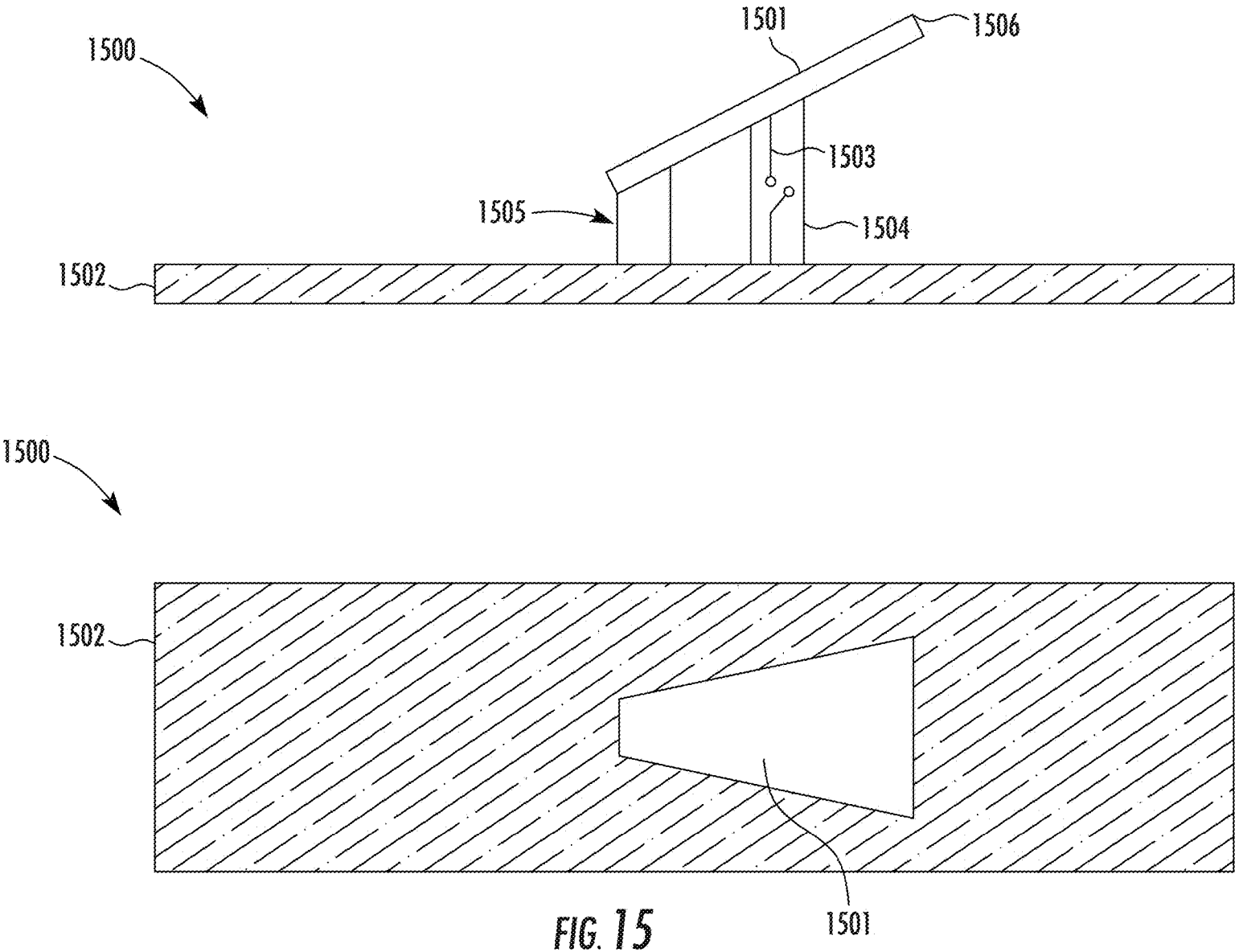
FIG. 15 illustrates a variable reflectance element with two conductive structures from a side view and a plan view.

FIG. 15 illustrates another example variable reflectance element 1500 both from a side and plan view. Element 1500 alters a phase shift provided by the element by alternating at what point along the length of body 1501 the body 1501 is wired to a ground plane 1502. Element 1500 again includes a variable impedance device 1503 embedded in a structure 1504. However, element 1500 includes an additional conductive structure 1505 that constantly wires body 1501 to ground. Variable impedance device 1503 can exhibit the same characteristics as element 1402 above and can respond to a similar control signal. However, the effect on the reflectance of variable reflectance element 1500 will be different because of the fact that body 1501 is continuously wired to ground.

In one approach, element 1500 is approximately X/4 long from the point at which it is permanently terminated to ground at 1505 to the alternative end at point 1506. In this case (grounded at only one end), element 1500 acts as a resonant element, and the reflected wave is in-phase with the incident wave. When variable impedance device 1503 is switched it creates an additional termination to the ground plane further along the electrical length of body 1501. Element 1500 is thereby switched from one state to another. In this situation, element 1500 becomes non-resonant, and the dominant reflection is from the conductive ground plane. The reflected wave is now out of phase with the incident wave, resulting in a substantial phase shift in the reflected energy. In one approach, the phase shift is nearly 180° degrees ($\pi$ radians).

Structures 1504 and 1505 can both be support structures or only one can be a support structure while the other merely provides a conductive electrical connection. In particular, structure 1505 could be a weld point that welds body 1501 to ground plane 1502.

FIG. 16 illustrates a pair 1600 of example variable reflectance elements from a side and plan view. Element 1600 alters a phase shift provided by the pair of variable reflectance elements by alternating between a connected and unconnected state. As illustrated the pair 1600 of variable reflectance elements include body 1601 and body 1602. The two bodies rest on support 1603. Support 1603 is insulating and does not conduct RF energy. As such, structure 1604 does not need to be a ground plane. However structure 1604 could still be the wall of the chamber or a specialized surface formed thereon. The pair of devices 1601 and 1602 share another structure 1605 with an embedded variable impedance device. As the variable impedance device alters between an open and a closed state, the pair of variable reflectance elements of element 1600 will each change their reflectance in that they are transitioning from a state in which they are floating to a state in which they are wired to an adjacent variable reflectance element. In the illustrated embodiment, the overall structure will remain floating, but each individual element can be conceptualized as no longer floating because it is connected to an external structure that will affect its bias point. The devices could also each be modified to have multiple associated variable impedance devices that would connect the body of the device to the other device at different locations.

Figure 17:
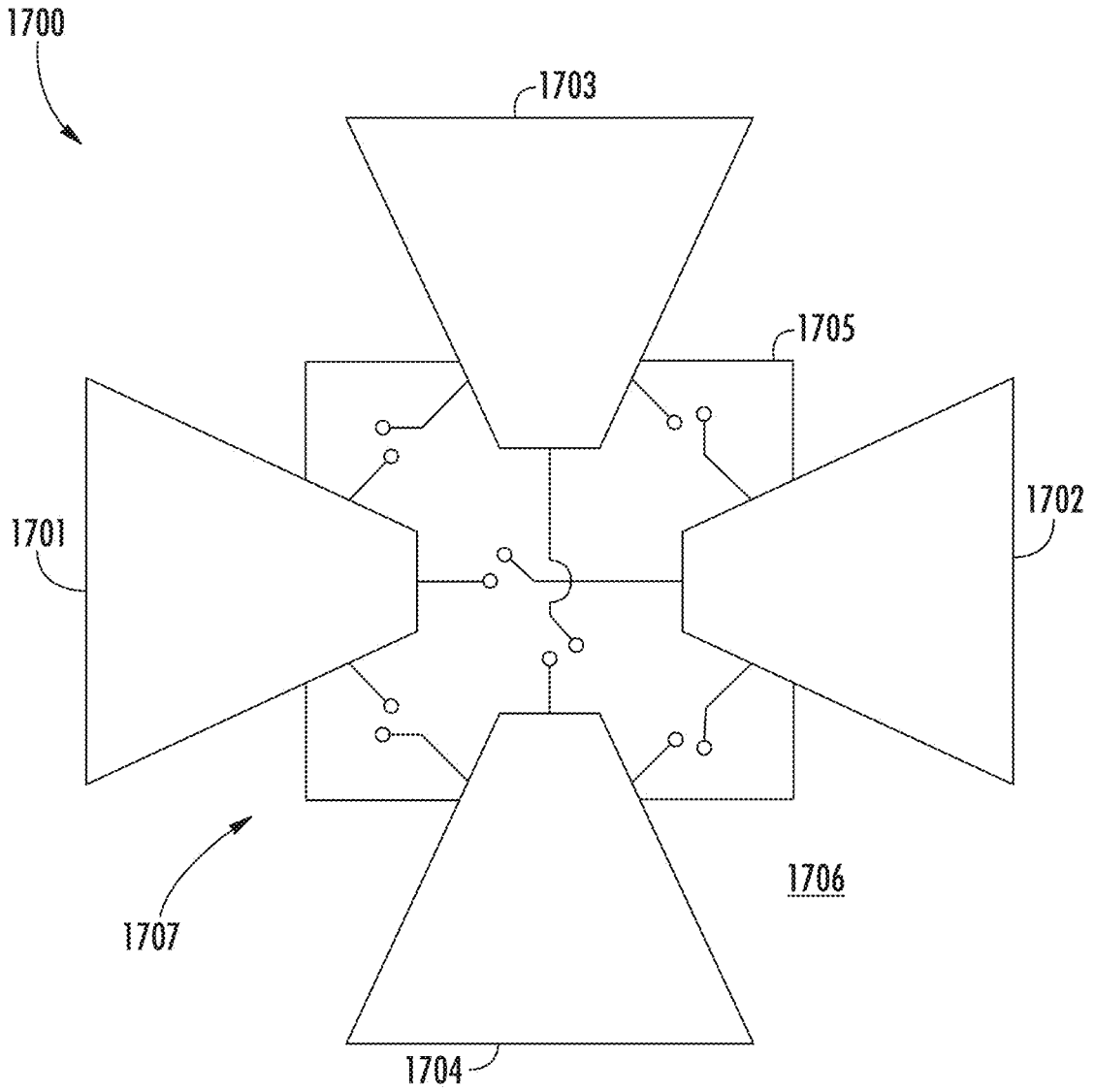
FIG. 17 illustrates a set of variable reflectance elements connected via a network of variable impedance devices from a plan view.

FIG. 17 illustrates a set of example variable reflectance elements 1700 from a plan view. The set of devices includes four monopole antenna elements 1701, 1702, 1703, and 1704 that are all resting on a single insulating support structure 1705. As with FIG. 16, the underlying structure 1706 does not need to be a ground plane, but it can still be the wall of the chamber or a specialized surface formed thereon. The devices are connected together via a network of variable impedance devices 1707. The control system that alters the state of the switches in network 1707 could be able to adjust the switches independently. As the reflectance of each element will be affected not only by which elements it is connected to, but by which elements those elements are in turn connected to, the number of potential reflectance values that the set of devices can exhibit can be described by 64 different states.

Figure 18:
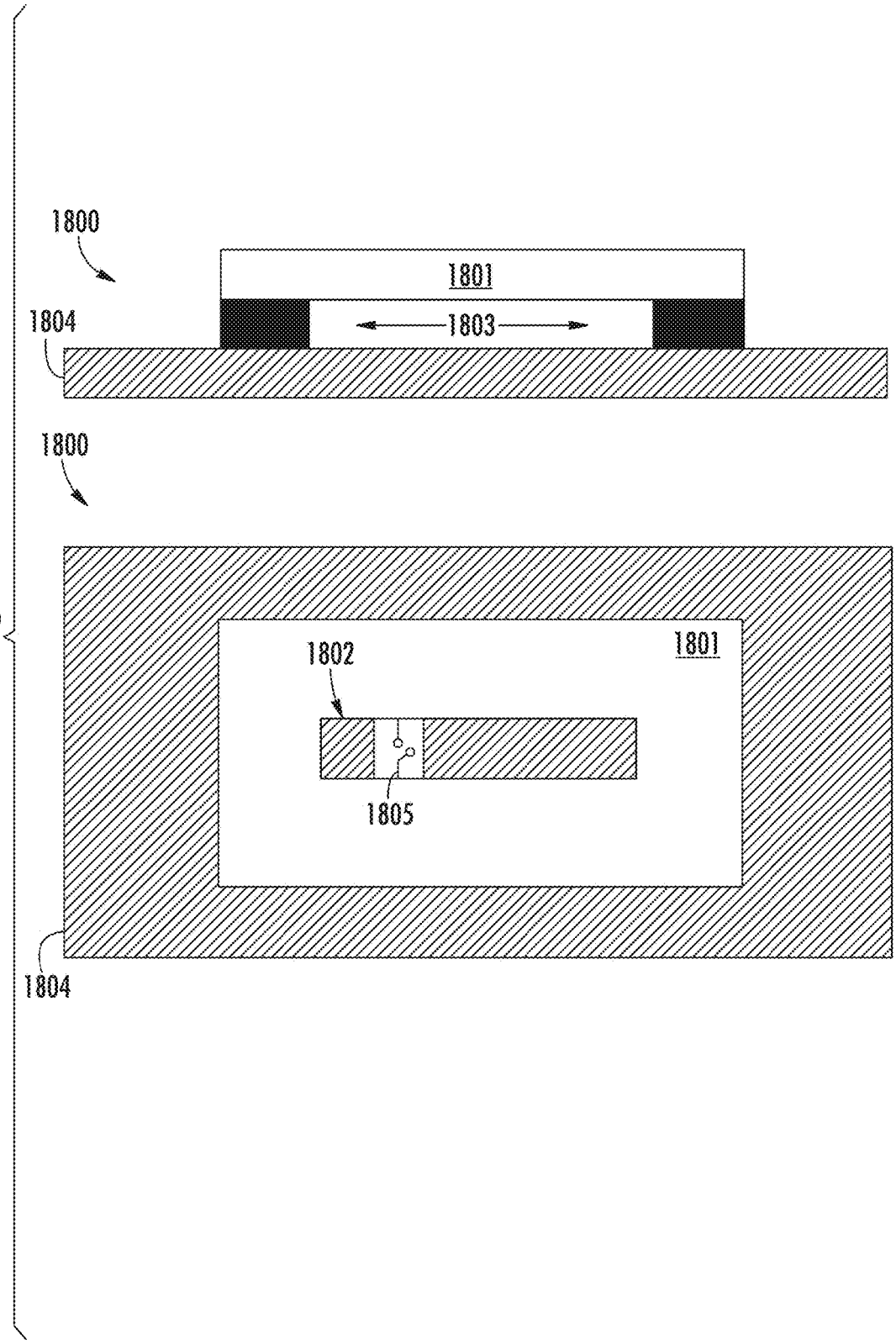
FIG. 18 illustrates a variable reflectance element with a slot configuration from a side view and a plan view.

FIG. 18 illustrates an example variable reflectance element 1800 from a side and plan view. As illustrated, the device includes a body 1801 in the shape of a slot antenna with a slot 1802. The width of slot 1802 (vertical dimension of slot 1802 in FIG. 18) can be much less than the wavelength of the energy applied to the chamber by the electronic oven. The length of the slot 1802 (horizontal dimension) can be appreciable compared to that wavelength. In particular, the length of slot 1802 could be half that wavelength. Body 1801 could be sheet metal or some other conductive material that can serve as a ground plane. Device 1800 also includes support structures 1803 that separate body 1801 from layer 1804. The support structures 1803 could be separate structures or they could be two portions of one contiguous piece of material. The support structure could be insulating material. The layer 1804 can be a wall of the chamber or a layer placed on the wall. In an alternative approach, body 1801 could be the wall of the chamber itself or a layer placed directly on the wall. In the latter case, slot 1802 could be a portion of the wall exposed by the removal of that layer. In the former case, slot 1802 could be an excavated portion of the wall such as a divot in the wall structure or a valley-shaped bend in the exterior of the wall. Element 1800 also includes a variable impedance device 1805 that can serve to alter the phase shift imparted to impending energy.

Variable impedance device 1805 could be a switch such as a PIN diode or FET. The switch could alter between two states which would likewise cause the variable reflectance element 1800 to alter between two states with different reflectance. As the variable impedance device alters between an open and a closed state, the variable reflectance element 1800 will alter the phase shift applied to impending energy because the effective length of slot 1802 as compared to the wavelength has been altered. The fact that the currents around the slot through body 1801 now have two looping paths they may take around the slot will also alter the reflectance of device 1800.

Figure 19:
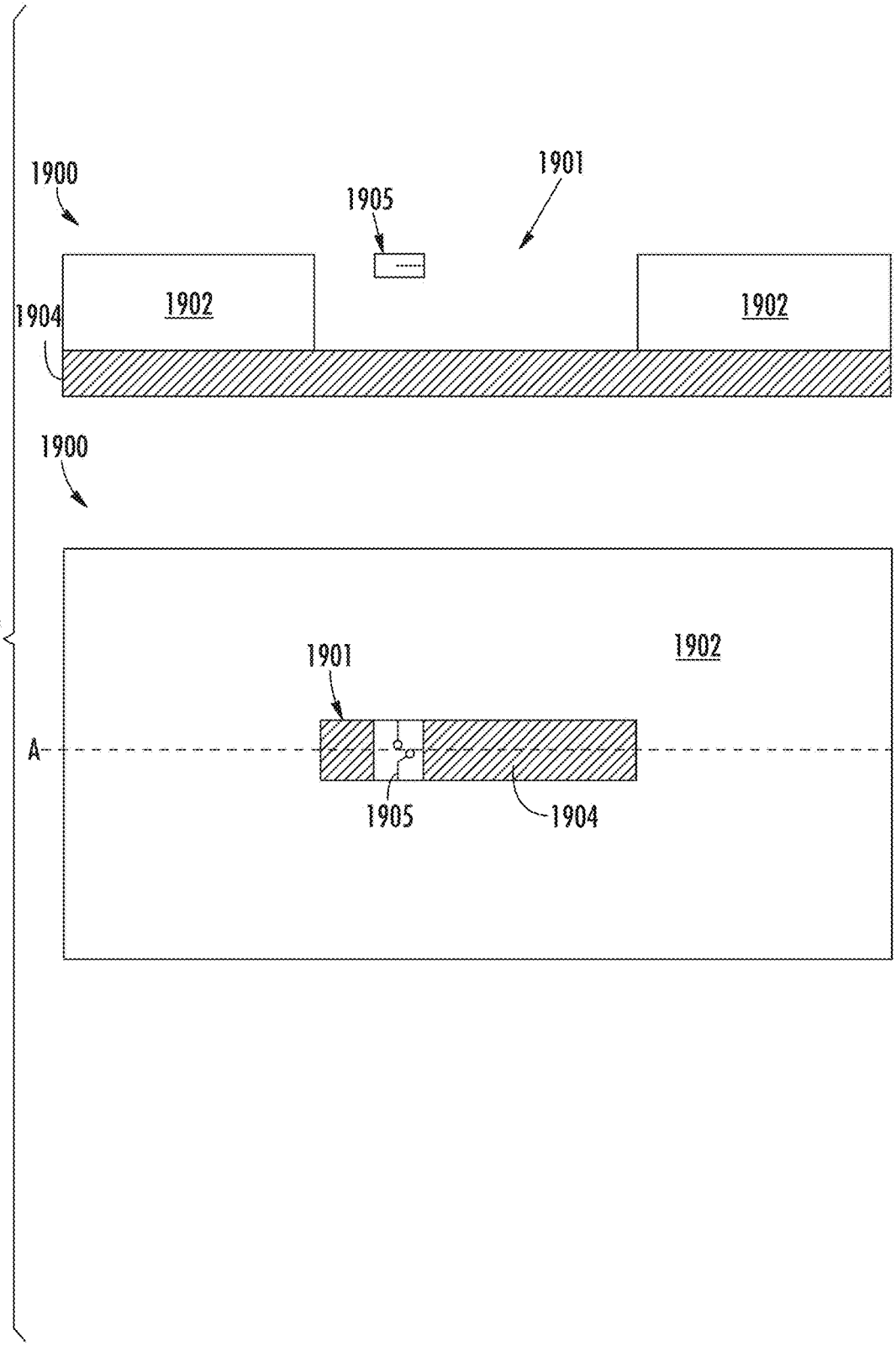
FIG. 19 illustrates a variable reflectance element with a slot configuration formed by a perforation in a wall of a chamber from a side view and a plan view.

FIG. 19 illustrates an example variable reflectance element 1900 from a side and plan view. The side view is cross sectional and is taken from reference line A on the plan view. The illustrated variable reflectance element 1900 is an example of one of the embodiments described above, where slot 1901 is formed by an excavated portion of the wall 1902 in the form of a perforation. Wall 1902 could be a continuous layer of sheet metal perforated with slots like slot 1901. Layer 1904 can be a solid wall of material such as sheet metal. Alternatively, layer 1904 can comprise one of numerous pockets placed on the back of wall 1902 in the vicinity of the perforations to prevent the leak of microwave energy from the chamber. The dimensions of slot 1901 can be similar to those of slot 1802. The depth of slot 1901 could be X/4 where X is a wavelength of energy applied to the chamber. For example, the wavelength of the wave of energy applied to the chamber with the shortest wavelength. Variable impedance device 1905 could exhibit the same physical and operational characteristics as variable impedance device 1805.

The individual elements of the array could be spaced, distributed, and oriented across the wall of the chamber in various ways. As mentioned previously, the array might cover every wall of the chamber, be limited to a single wall, or span multiple walls. There may also be multiple arrays in the chamber with their own varying spacing, distribution, and orientation. Also as mentioned previously, elements in the array could be placed at the center of every square inch on a wall of the electronic oven. However, the density could also be less than one element per square inch such as less than one element per every 6 square inches. To the extent the individual elements are not symmetrical around a center point, the orientation of the individual elements relative to each other could be constant or could be varied from element to element within the chamber. In implementations in which the orientation of the individual elements was constant, the orientation could vary in different implementations relative to the chamber itself. For example, all of the elements could be oriented along the x, y, or z-axis of the chamber.

Figure 20:
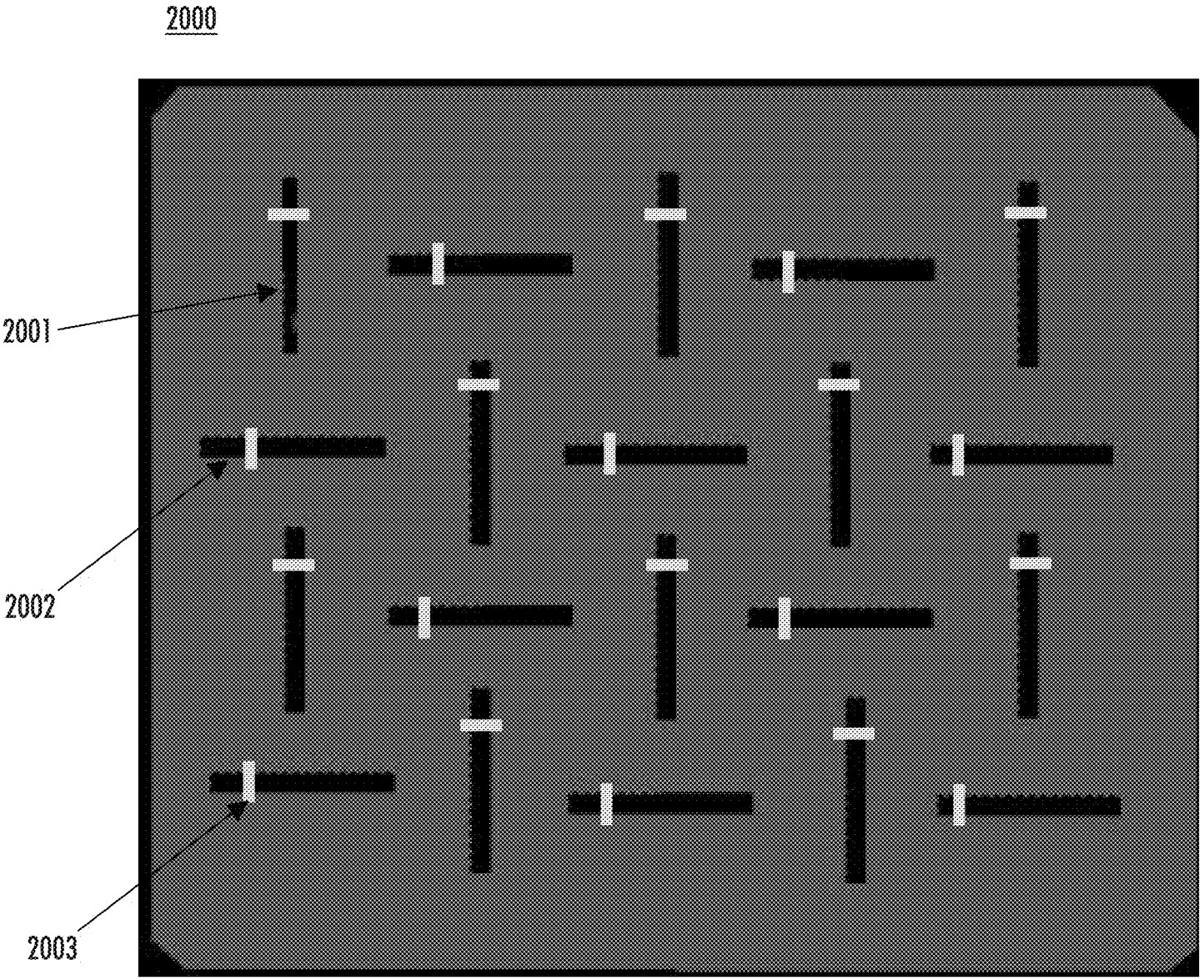
FIG. 20 illustrates an array of variable reflectance elements with varying relative orientations.

The orientation of the individual elements can be altered throughout the array so that a particular polarization is not favored. For example, FIG. 20 provides an illustration of an array 2000 of variable reflectance elements in the style of FIG. 18 that are distributed with two different orientations in a repeating pattern across the array. As illustrated, one set of elements in the array have a first orientation 2001, and a second set of elements in the array have a second orientation 2002. Each element also includes a variable impedance element 2003 that spans the slot of the element. Each element in the array has the same orientation as half of its neighbors and a different orientation from the other half of its neighbors. The first orientation and second orientation differ by 90°. In other approaches, the elements in the array could have more than two orientations. The variance in orientation could also be randomly distributed across the array, or follow a more complex pattern than that illustrated by FIG. 20. For example, the orientation could change by a set number of degrees less than 90° in a continuous stepwise manner across the array from one neighbor to the next.

The variable impedance elements could be any element that is capable of exhibiting different impedance values at a given frequency. The variable impedance elements could be mechanical or electromechanical devices. The variable impedance elements could also comprise passive or active electronic circuitry. The variable impedance elements could be a solenoid or relay making a variable physical connection to the body of an associated variable reflectance elements. The variable impedance elements could be an electromechanical switch with a variable low impedance capacitive connection.

Certain benefits accrue to approaches in which the variable impedance elements are solid state devices in that there would be a decrease in moving parts required to operate in or on the electronic oven. In one example, the variable impedance elements could be varactors or a network of passive device with variable impedance such as potentiometers or variable inductors. The varactors could be capacitors designed with a variable distance between capacitor plates to adjust that capacitance of the capacitor. In another example, the variable impedance elements could alternatively include switches such as field effect transistors. The switching devices could be any power switching device such as a FET, BJT, or PIN diode. In particular, the switches could be lateral diffusion metal oxide semiconductor (LDMOS) FETs that were specifically applicable for high power applications. In another example, the variable impedance devices could be PIN diodes or other devices used for radio frequency or high power applications. The power devices could be designed to hold off voltages in the off state of greater than 500 V and present an on state resistance of less than 250 mΩ.

In some of the approaches disclosed herein, there is a paucity of moving parts required for the electronic oven to deliver energy in a variable manner to the item being heated. In certain approaches, the electronic oven does not include any components that are in mechanical motion between when the first electromagnetic wave is applied in step 1101 and when the second electromagnetic wave is applied in step 1121. In particular, if the variable impedance devices are solid state devices, they can alter the phase of the variable reflectance elements in response to a purely electrical command received from the control system and do not need to make any mechanical movements in response while still being able to modify the reflectance of the variable reflectance elements. Also, since the distribution of energy can be steered using the array of variable reflectance elements, more even heating can be achieved without the use of a mode stirrer or movable tray for the item to rest on. Furthermore, if a standard magnetron is replaced with a microwave energy converter that utilizes solid state devices alone, there is the potential for no moving parts to lie on the entire energy path from the AC mains voltage to the item being heated.

FIG. 21 illustrates an example variable reflectance element 2100 both from a side view (top image of FIG. 21) and plan view (bottom image of FIG. 21). Element 2100 alters a distribution of energy by altering its physical position from a first position to a second position. Element 2100 includes a reflective element 2101 which in this case is a relatively flat piece of conductive material that could be formed of sheet metal such as aluminum, steel, or copper. The reflective element 2101 is held above a surface of the chamber, defined by chamber wall 2102, by a dielectric spindle 2103 that extends through a discontinuity 2104 in the chamber wall. The spindle is dielectric, passes through a small perforation, and is generally configured to avoid creating an antenna for microwave energy to leak out of the chamber. A motor on the exterior of the chamber is able to rotate reflective element 2101 via dielectric spindle 2103 by imparting a force to the spindle as illustrated by arrow 2105. The force could be applied by a rotor attached to spindle 2103. The motor is able to rotate the spindle between a set of positions selected from a fixed set of positions. For example, the motor could adjust the spindle so that the reflective element 2101 was rotated back and forth through a 90° arc.

Figure 22:
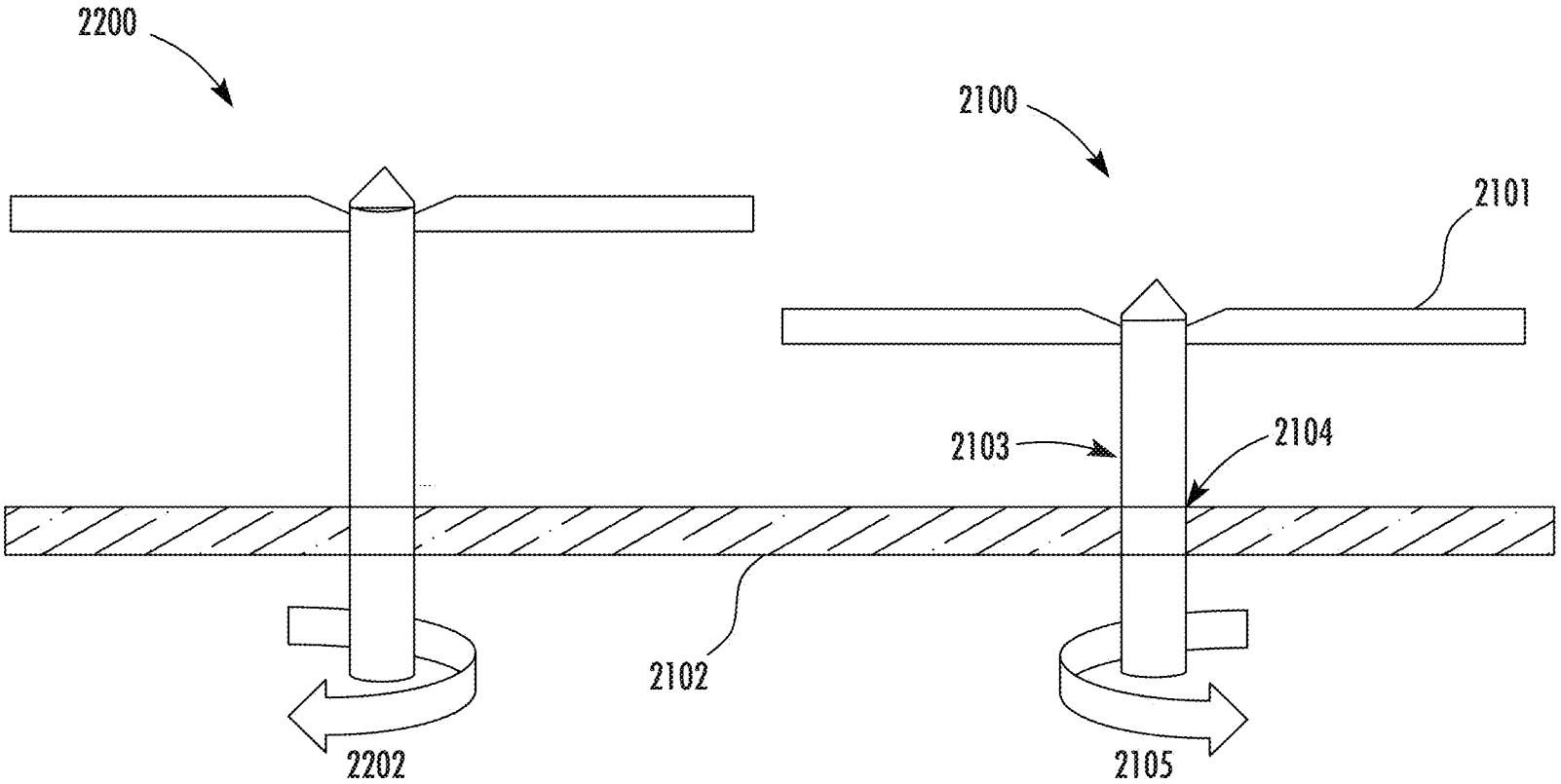
FIG. 22 illustrates a set of variable reflectance elements with varying heights.

FIG. 22 illustrates a set of variable reflectance elements including variable reflectance element 2100 from FIG. 21, and an additional variable reflectance element 2200. The two elements are shown to illustrate the fact that a set of variable reflectance elements in a particular implementation can be treated independently by a controller, and further do not need to be uniform elements. In the particular example of reflective elements held above a surface of the chamber, the dielectric spindles can hold the devices at different heights. Each element in a set of elements could have its own unique height. In the illustrated case, the set includes two elements for purposes of illustration. However, the set of elements in the chamber can be a set of at least three units, and in certain implementations will include many more than three units. Element 2100 and element 2200 are provided to show that each reflective element can be associated with a discontinuity, a dielectric spindle, and a motor that are all unique to that element. As illustrated, element 2200 could rotate in the opposite direction 2202 as the direction of element 2100 which is rotated at the same time.

FIG. 23 provides an example of the performance of an electronic oven operating in accordance with specific approaches described above. FIG. 23 includes two images 2300 and 2310. Image 2300 shows two eggs that have been evenly cooked in accordance with an electronic oven generally in accordance with the disclosure above. The oven included a set of 19 reflective elements similar to the configuration shown in FIG. 9, and was programmed to evaluate the item being heated using an infrared camera and adjust the reflective elements to evenly apply heat to the eggs. Image 2310 shows two eggs in the same tray that were placed in a chamber and exposed to the same overall level of energy for the same amount of time as the eggs in image 2300. However, the electronic oven used to cook the eggs in image 2310 attempted to evenly distribute heat by moving the eggs throughout the heating process on a traditional rotating tray. The images are fairly self-explanatory. They show that the two eggs placed on the traditional rotating tray were not evenly cooked. The yolks of one of the eggs ruptured. The consistency of both yolks was not even and the whites were burned in several locations. In contrast, the eggs in image 2310 were evenly cooked with the yolks exhibiting the same consistency throughout.

While the specification has been described in detail with respect to specific embodiments of the invention, it will be appreciated that those skilled in the art, upon attaining an understanding of the foregoing, may readily conceive of alterations to, variations of, and equivalents to these embodiments. Although the specific cross sections of the variable reflectance elements showed an associated variable impedance device within the chamber, the variable impedance devices could be outside the chamber and electrically connect to the body of the device via a port in the chamber. Any of the method steps discussed above can be conducted by a processor operating with a computer-readable non-transitory medium storing instructions for those method steps. The computer-readable medium may be memory within the electronic oven or a network accessible memory. Although examples in the disclosure included heating items through the application of electromagnetic energy, any other form of heating could be used in combination or in the alternative. The term "item" should not be limited to a single homogenous element and should be interpreted to include any collection of matter that is to be heated. These and other modifications and variations to the present invention may be practiced by those skilled in the art, without departing from the scope of the present invention, which is more particularly set forth in the appended claims.

What is claimed is:

1. An electronic oven comprising:

a chamber with a first injection port;

a microwave energy source coupled to the first injection port;

a set of at least three variable reflectance elements;

a set of at least three variable impedance devices for controlling a distribution of microwave energy in the electronic oven;

a control system;

wherein the elements in the set of at least three variable reflectance elements each have a reflectance;

wherein the devices in the set of at least three variable impedance devices each have an impedance;

wherein the elements in the set of at least three variable reflectance elements and the devices in the set of at least three variable impedance devices are in one-to-one correspondence;

wherein altering the impedances of the variable impedance devices alters the reflectances of the corresponding variable reflectance elements; and wherein the control system alters the reflectances of the elements in the set of at least three variable reflectance elements by altering the impedances of the devices in the set of at least three variable impedance devices.

2. The electronic oven of claim 1, further comprising:

a magnetron;

a waveguide;

wherein the magnetron: (i) forms the microwave energy source; (ii) receives alternating current (AC) power from a mains voltage source; (iii) converts the AC power to microwave energy; and (iv) couples to the first injection port by the waveguide;

wherein the chamber solely receives microwave energy from the first injection port; and wherein the set of at least three variable reflectance elements are a set of non-radiative elements.

3. The electronic oven of claim 1, wherein:

the microwave energy source applies an electromagnetic wave to the chamber;

the electromagnetic wave has a dominant wavelength; and the elements in the set of at least three variable reflectance elements are spaced apart from each other by a distance greater than one half of the dominant wavelength.

4. The electronic oven of claim 1, wherein:

the control system: (i) stores a corresponding current impedance value independently for each device in the set of at least three variable impedance devices; and (ii) stores instructions that alter the corresponding current impedance value in response to the change of impedances of the devices in the set of at least three variable impedance devices.

5. The electronic oven of claim 1, wherein:

the control system: (i) stores a corresponding current impedance value independently for each device in the set of at least three variable impedance devices; and (ii) changes the impedances of the devices in the set of at least three variable impedance devices in response to the altering of the corresponding current impedance value.

6. The electronic oven of claim 1, further comprising:

a magnetron;

a waveguide;

wherein the magnetron: (i) forms the microwave energy source; (ii) receives alternating current (AC) power from a mains voltage source; (iii) converts the AC power to microwave energy; and (iv) couples to the first injection port by the waveguide;

wherein the microwave energy source applies an electromagnetic wave to the chamber;

wherein the electromagnetic wave has a dominant polarization;

wherein a first polarization is perpendicular to the dominant polarization;

wherein a second polarization is parallel to the dominant polarization; and wherein the control system stores instructions to adjust at least one variable reflectance element in the set of at least three variable reflectance elements between the first polarization and the second polarization.

7. The electronic oven of claim 1, wherein:

the microwave energy source applies an electromagnetic wave to the chamber;

the set of at least three variable reflectance elements is physically immobile with respect to the electronic oven; and altering the impedances of the devices in the set of at least three variable impedance devices virtually resizes the chamber with respect to the electromagnetic wave.

8. The electronic oven of claim 1, further comprising:

a false floor of the chamber;

wherein the microwave energy source applies an electromagnetic wave to the chamber;

wherein the electromagnetic wave has a dominant wavelength;

wherein the set of at least three variable reflectance elements is located below the false floor; and wherein a vertical distance, measured perpendicular to the false floor, and between the false floor and the set of at least three variable reflectance elements, is less than 0.159 of the dominant wavelength.

9. The electronic oven of claim 1, wherein:

the first injection port is positioned on an opposite side of the chamber from the set of at least three variable reflectance elements.

10. The electronic oven of claim 1, further comprising:

a false ceiling of the chamber;

wherein the first injection port is positioned on a surface of the chamber; and wherein the set of at least three variable reflectance elements is located between the false ceiling and the surface of the chamber.

11. The electronic oven of claim 10, wherein:

the microwave energy source applies an electromagnetic wave to the chamber;

the electromagnetic wave has a dominant wavelength; and a vertical distance, measured perpendicular to the false ceiling, and between the surface of the chamber and the set of at least three variable reflectance elements, is less than 0.6 of the dominant wavelength.

12. The electronic oven of claim 1, further comprising:

the chamber with a second injection port;

wherein the chamber solely receives microwave energy from the second injection port; and wherein the set of at least three variable reflectance elements are a set of non-radiative elements.

13. The electronic oven of claim 1, wherein:

the set of at least three variable impedance devices consists of solid state devices.

14. The electronic oven of claim 1, wherein:

the set of at least three variable impedance devices consists of one type of device selected from the group consisting of: PIN diodes and field effect transistors.

15. The electronic oven of claim 1, wherein:

the microwave energy source applies an electromagnetic wave to the chamber;

the electromagnetic wave has a dominant wavelength; and altering the impedances of the devices in the set of at least three variable impedance devices virtually resizes the chamber with respect to the electromagnetic wave.

16. The electronic oven of claim 1, wherein:

the control system alters the impedances of the devices in the set of at least three variable impedance devices from a first state to a second state;

the corresponding elements in the set of at least three variable reflectance elements are not wired to ground in the first state; and the corresponding elements in the set of at least three variable reflectance elements are wired to ground in the second state.

17. A method for heating an item in a chamber of an electronic oven comprising:

applying a first electromagnetic wave to the chamber from an energy source to a set of variable reflectance elements, wherein the set of variable reflectance elements includes a corresponding set of variable impedance devices, and wherein the corresponding set of variable impedance devices includes a first variable impedance device and a second variable impedance device;

reflecting, when the first variable impedance device has a first impedance value, the first electromagnetic wave from the set of variable reflectance elements to the item, wherein the reflecting places a local maximum of energy at a first location on the item;

altering an impedance of the first variable impedance device from the first impedance value to a second impedance value;

applying, after altering the impedance of the first variable impedance device to the second impedance value, a second electromagnetic wave to the chamber from the energy source;

reflecting the second electromagnetic wave from the set of variable reflectance elements to the item, wherein the reflecting places the local maximum of energy at a second location on the item, and wherein the first location and second location are different; and wherein altering the impedance of the first variable impedance device alters a reflectance of a first variable reflectance element in the set of variable reflectance elements.

18. The method of claim 17 further comprising:

altering an impedance of the second variable impedance device from the second impedance value to the first impedance value;

wherein the second electromagnetic wave is applied to the chamber from the energy source after altering the impedance of the second variable impedance device from the second impedance value to the first impedance value; and wherein altering the impedance of the second variable impedance device alters a reflectance of a second variable reflectance element in the set of variable reflectance elements.

19. The method of claim 18 wherein applying the first and second electromagnetic waves to the chamber comprises:

receiving AC power from a mains voltage source;

converting the AC power to microwave energy using a magnetron; and delivering the microwave energy to the chamber via an injection port in the chamber using a waveguide from the magnetron to the injection port;

wherein the chamber does not receive any microwave energy besides the microwave energy from the injection port; and wherein the first and second variable reflectance elements are non-radiative elements.

20. The method of claim 18, wherein:

the first electromagnetic wave has a frequency with a wavelength; and altering the impedance of the first variable impedance device virtually resizes the chamber by a quarter of the wavelength.

21. The method of claim 19, wherein:

the first variable reflectance element and the second variable reflectance element are dipole antennas;

the first variable impedance device and the second variable impedance device are lateral diffusion metal oxide semiconductor transistors;

the corresponding set of variable impedance devices is located on a first wall of the chamber;

the injection port is located on a second wall of the chamber; and the electronic oven has no components in mechanical motion between when the first electromagnetic wave is applied and when the second electromagnetic wave is applied.

22. The method of claim 18, wherein applying the first and second electromagnetic waves to the chamber comprises:

receiving AC power from a mains voltage source;

converting the AC power to microwave energy using a magnetron; and delivering the microwave energy to the chamber via an injection port in the chamber using a waveguide from the magnetron to the injection port;

wherein the first and second variable reflectance elements only receive microwave energy via the chamber; and wherein the first and second variable reflectance elements only receive microwave energy from the magnetron.

23. The method of claim 17 wherein:

the first electromagnetic wave has a frequency;

the first impedance value has a first phase at the frequency;

the second impedance value has a second phase at the frequency; and the first phase and the second phase are different.

24. The method of claim 17, wherein altering the impedance of the first variable impedance device comprises:

altering the first variable reflectance element from a first state to a second state;

wherein the first variable reflectance element is not wired to ground in the first state; and wherein the first variable reflectance element is wired to ground in the second state.

25. The method of claim 17, wherein altering the impedance of the first variable impedance device comprises:

altering the first variable reflectance element from a first state to a second state;

wherein the first variable reflectance element is wired to a third variable reflectance element in the first state; and wherein the first variable reflectance element is not wired to the third variable reflectance element in the second state.

26. An electronic oven for heating an item comprising:

a chamber;

an injection port in a first wall of the chamber;

a microwave energy source for applying microwave energy to the chamber via the injection port;

a set of variable reflectance elements with a first variable reflectance element and a second variable reflectance element;

a set of variable impedance devices with a first variable impedance device that has a one-to-one correspondence with the first variable reflectance element; and a control system that varies an impedance of the first variable impedance device from a first value to a second value;

wherein, when the impedance of the first variable impedance device has the first value, the first variable reflectance element is floating; and wherein, when the impedance of the first variable impedance device has the second value, the first variable reflectance element is one of: (i) wired to ground; or (ii) wired to the second variable reflectance element.

27. The electronic oven of claim 26, further comprising:

a false floor of the chamber;

wherein the first wall is a ceiling of the chamber; and wherein the set of variable reflectance elements is located below the false floor.

28. The electronic oven of claim 26, further comprising:

a magnetron;

a waveguide;

wherein the magnetron: (i) forms the microwave energy source; (ii) receives alternating current (AC) power from a mains voltage source; (iii) converts the AC power to microwave energy; and (iv) couples to the injection port by the waveguide;

wherein the chamber solely receives microwave energy from the injection port; and wherein the set of variable reflectance elements are non-radiative elements.

29. The electronic oven of claim 26, wherein:

the control system stores a corresponding current impedance value independently for each variable impedance device in the set of variable impedance devices.

30. The electronic oven of claim 26, wherein:

the set of variable impedance devices consists of one type of device selected from the group consisting of: PIN diodes and field effect transistors.

* * * * *